US010662647B2

(12) United States Patent
Kilian et al.

(10) Patent No.: US 10,662,647 B2
(45) Date of Patent: May 26, 2020

(54) FACETED ARCHITECTURAL FIXTURES

(71) Applicant: Arktura LLC, Gardena, CA (US)

(72) Inventors: Robert Kilian, Venice, CA (US); Chris Kabatsi, Venice, CA (US); Kevin Kane, Los Angeles, CA (US); John Johnston, Los Angeles, CA (US)

(73) Assignee: Arktura LLC, Gardena, CA (US)

( * ) Notice: Subject to any disclaimer, the term of this patent is extended or adjusted under 35 U.S.C. 154(b) by 0 days.

(21) Appl. No.: 15/261,710

(22) Filed: Sep. 9, 2016

(65) Prior Publication Data

US 2017/0073968 A1 Mar. 16, 2017

Related U.S. Application Data

(60) Provisional application No. 62/217,645, filed on Sep. 11, 2015.

(51) Int. Cl.

| | |
|---|---|
| ***E04B 9/34*** | (2006.01) |
| ***E04B 9/22*** | (2006.01) |
| ***E04B 9/04*** | (2006.01) |
| ***E04B 9/12*** | (2006.01) |
| *E04B 9/06* | (2006.01) |
| *E04B 9/16* | (2006.01) |

(52) U.S. Cl.

CPC ..... *E04B 9/225* (2013.01); *E04B 9/0414* (2013.01); *E04B 9/127* (2013.01); *E04B 9/065* (2013.01); *E04B 9/16* (2013.01); *E04B 9/34* (2013.01)

(58) Field of Classification Search

CPC . E04B 9/16; E04B 9/065; E04B 9/127; E04B 9/0414; E04B 9/225; E04B 1/3211; E04B 2001/3276; E04B 2001/3294; A63F 9/088; A63H 33/16; E04C 2/326; E04C 3/28; Y10S 52/10; B21D 5/16

USPC ..... 52/144; 428/181; 446/488; 273/155; 72/379.2

See application file for complete search history.

(56) References Cited

U.S. PATENT DOCUMENTS

| | | | | | |
|---|---|---|---|---|---|
| 2,837,632 | A | * | 6/1958 | Lipscomb | F21V 11/00 362/342 |
| 2,882,990 | A | * | 4/1959 | Mustoe | G10K 11/16 181/284 |
| 2,918,814 | A | * | 12/1959 | Farina | E04B 9/0435 52/474 |
| 2,935,152 | A | * | 5/1960 | Maccaferri | E04B 9/001 181/290 |
| 3,321,877 | A | * | 5/1967 | Alexieff | E04B 9/001 181/284 |
| 3,343,309 | A | * | 9/1967 | Netz | E04B 9/16 362/150 |
| 3,466,830 | A | * | 9/1969 | Smith | E04B 9/003 160/183 |
| 3,633,273 | A | * | 1/1972 | Wilburn | H01F 27/2847 29/602.1 |

(Continued)

OTHER PUBLICATIONS

Sara Janye Cole, Feb. 10, 2011, Metal Clay Origami, Feb. 10, 2011, Rio Grande, http://riograndeblog.com/metal-clay-origami-jewelry-with-sara-jayne-cole/.*

*Primary Examiner* — Joshua J Michener
*Assistant Examiner* — James Buckle, Jr.
(74) *Attorney, Agent, or Firm* — Matthew J. Spark; Stefan J. Kirchanski; Zuber Lawler & Del Duca LLP

(57) ABSTRACT

A faceted architectural fixture is provided that include one or more folded elongated strips, each providing a series of alternating faceted surfaces.

19 Claims, 24 Drawing Sheets

(56) References Cited

U.S. PATENT DOCUMENTS 3,746,345 A * 7/1973 Palazzolo ..... A63F 9/088 273/155
3,749,636 A * 7/1973 Tranquillitsky ... B65D 19/0002 428/51
3,871,143 A * 3/1975 Quick ..... E04B 1/32 52/309.1
3,914,486 A * 10/1975 Borgford ..... B32B 3/12 428/73
4,020,205 A * 4/1977 Haselbauer ..... B32B 3/12 428/116
4,096,479 A * 6/1978 Van Buskirk ..... H01Q 15/18 342/7
4,471,596 A * 9/1984 Deaton ..... E04B 9/345 362/319
4,672,780 A * 6/1987 Lockwood ..... E04B 1/3211 52/630
4,719,726 A * 1/1988 Bergman ..... E04B 1/3211 52/81.4
4,746,471 A * 5/1988 Hale ..... E04G 11/04 264/32
4,776,139 A * 10/1988 Lockwood ..... E04B 1/3211 29/432.1
4,976,652 A * 12/1990 Schwartz ..... A63H 33/04 273/157 R
5,234,727 A * 8/1993 Hoberman ..... A63H 33/16 428/12
D373,831 S * 9/1996 Lechleiter ..... D25/58
5,735,520 A * 4/1998 Matos ..... A63F 9/088 273/155
6,082,056 A * 7/2000 Hoberman ..... A63F 9/088 52/109
6,264,199 B1 * 7/2001 Schaedel ..... A63F 9/088 273/155
6,315,632 B1 * 11/2001 Gibbons ..... A63F 9/181 273/161
6,374,564 B1 * 4/2002 Fletterick ..... E04B 9/0407 52/506.07
D464,737 S * 10/2002 Gulbrandsen ..... D25/58
6,622,579 B1 * 9/2003 Muth ..... B64G 1/222 73/865.6
6,834,467 B2 * 12/2004 Gulbrandsen ..... E04B 9/00 52/506.06
6,935,997 B2 * 8/2005 Kling ..... G06T 17/20 493/356
7,284,782 B2 * 10/2007 Uenuma ..... B60J 1/00 296/84.1
7,406,802 B2 * 8/2008 Stackenwalt ..... E04B 9/0414 52/22
7,428,801 B2 * 9/2008 Ostenfeldt ..... E04B 9/0414 52/144
7,752,821 B2 * 7/2010 Jankovec ..... E04B 9/061 248/57
D623,319 S * 9/2010 Martin ..... D25/141
D623,320 S * 9/2010 Martin ..... D25/141
7,909,297 B1 * 3/2011 Harris ..... A47B 83/04 248/220.21
7,913,466 B2 * 3/2011 Stackenwalt ..... E04B 9/0414 52/222
D644,751 S * 9/2011 Martin ..... D25/138
D644,752 S * 9/2011 Martin ..... D25/138
D645,578 S * 9/2011 Martin ..... D25/138
D651,728 S * 1/2012 Martin ..... D25/138
8,096,089 B2 * 1/2012 Platt ..... E04B 9/0414 52/316
D686,348 S * 7/2013 Martin ..... D25/138
8,733,053 B2 5/2014 Kilian
8,782,987 B2 7/2014 Kilian
8,966,833 B2 * 3/2015 Ally ..... E04B 1/41 52/122.1
9,108,239 B2 * 8/2015 Takahashi ..... B21D 13/10
9,181,696 B1 * 11/2015 Bergman ..... E04B 9/16
D777,944 S * 1/2017 Kilian ..... D25/58
D777,946 S * 1/2017 Kilian ..... D25/58
9,707,731 B2 * 7/2017 Wood ..... B31D 5/006
2002/0152704 A1 * 10/2002 Thompson ..... E04B 2/7416 52/506.01
2003/0019179 A1 * 1/2003 Colson ..... E04B 9/00 52/506.06
2005/0011150 A1 * 1/2005 Stackenwalt ..... E04B 9/00 52/311.1
2006/0016145 A1 * 1/2006 Lonneman ..... E04B 9/0414 52/506.06
2006/0101764 A1 * 5/2006 Jankovec ..... E04B 9/061 52/506.07
2008/0307724 A1 * 12/2008 Krantz-Lilienthal ..... E04B 9/0414 52/222
2011/0146183 A1 * 6/2011 Wilkens ..... E04B 9/0414 52/506.06
2012/0186175 A1 * 7/2012 Gerkes ..... E04B 9/006 52/220.6
2015/0060193 A1 * 3/2015 Thun ..... E04B 9/34 181/286
2015/0121772 A1 * 5/2015 Berken ..... E04B 1/34331 52/28
2015/0240490 A1 * 8/2015 Firinga ..... E04B 9/20 52/506.05
2015/0289344 A1 * 10/2015 Leadford ..... H05B 33/086 315/294
2015/0345724 A1 * 12/2015 Leadford ..... H05B 33/086 362/244
2016/0039164 A1 * 2/2016 Tuczek ..... B31D 3/005 428/57
2016/0145863 A1 * 5/2016 Bergman ..... E04B 9/225 52/506.05
2016/0251855 A1 * 9/2016 Heesbeen ..... E04B 9/16 52/506.05

* cited by examiner

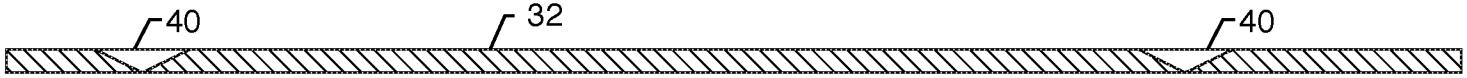
FIG. 5A
FIG. 5B
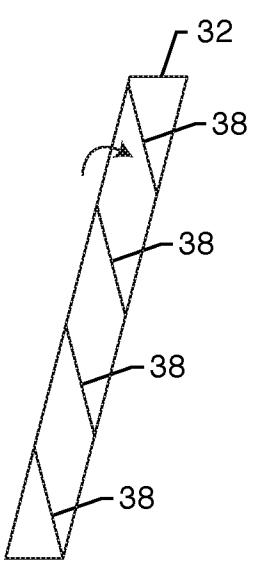
FIG. 5C
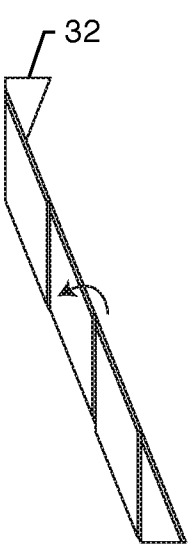
FIG. 5D
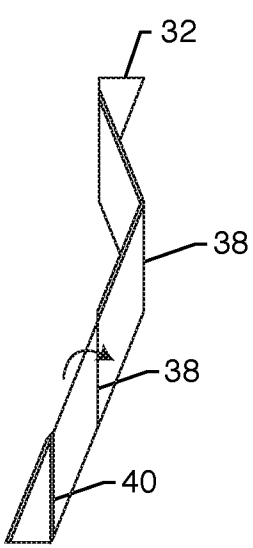
FIG. 5E
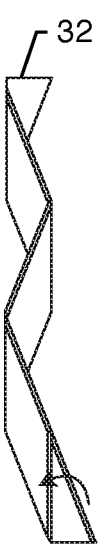
FIG. 5F
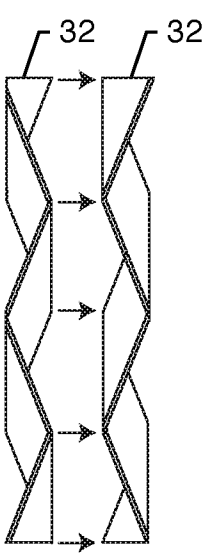
FIG. 5G
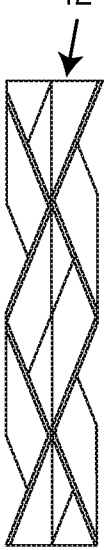
FIG. 5H

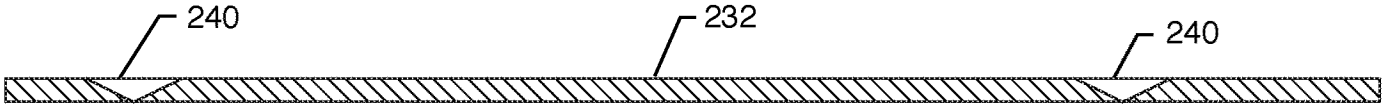
FIG. 17A
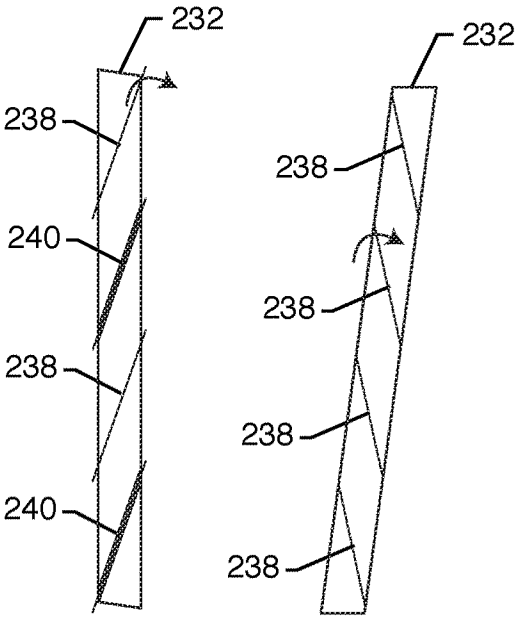
FIG. 17B
FIG. 17C
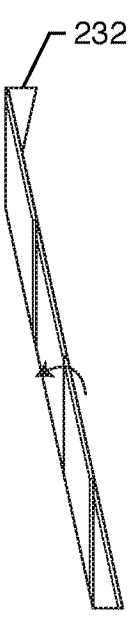
FIG. 17D
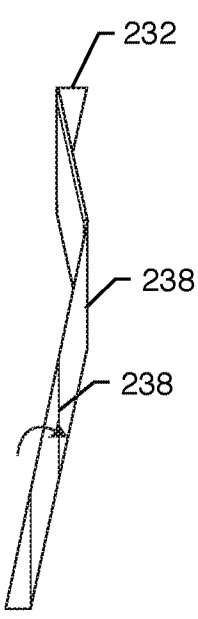
FIG. 17E
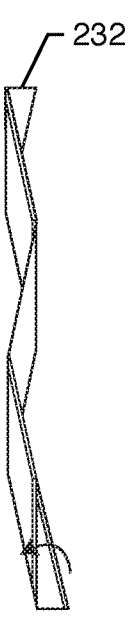
FIG. 17F
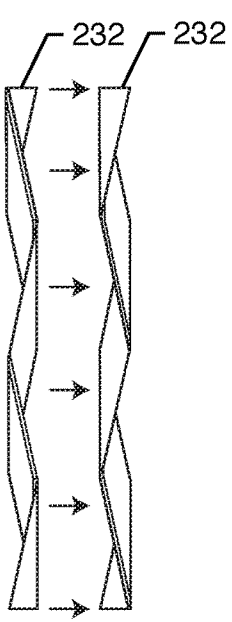
FIG. 17G
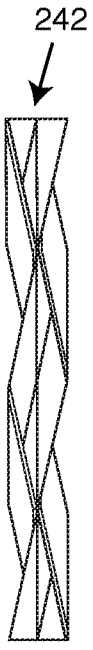
FIG. 17H

FACETED ARCHITECTURAL FIXTURES

FIELD OF THE INVENTION

The present invention relates generally to the field of ceiling and wall fixtures. More particularly, the present invention relates to a faceted architectural fixture.

BACKGROUND OF THE INVENTION

Fixtures including acoustical materials have conventionally provided only horizontally oriented surfaces or vertically oriented planar segments.

Co-owned U.S. Pat. No. 8,733,053 discloses systems and methods for supported architectural designs. Co-owned U.S. Pat. No. 8,782,987 discloses supported architectural structures.

There is a need for new types of acoustical ceiling and wall architectural fixtures. There is a further need for an improved architectural fixture providing a faceted surface. There is an additional need for an improved architectural fixture that provides a modular construction. There is also a need for an improved architectural fixture that provides a support structure for engagement of the architectural fixture with a surface. There is a need for an improved architectural fixture that provides engagement of modules with the support structure. There is a need for an improved architectural fixture that provides sound-absorption/sound attenuation benefits. The present invention satisfies these needs and provides other related advantages.

SUMMARY OF THE INVENTION

An architectural fixture described herein provides a faceted surface. An architectural fixture described herein provides a modular construction. An architectural fixture described herein provides a support structure for engagement of the architectural fixture with a surface. An architectural fixture described herein provides engagement of modules with the support structure. An architectural fixture described herein provides sound-absorption/sound attenuation benefits.

An embodiment of the invention provides an architectural fixture module having a top side and a bottom side and a length, that includes at least one unit structure comprising at least one folded elongated strip, such as one folded elongated strip or two or more side-by-side adjacent folded elongated strips, in which each folded elongated strip has a longitudinal axis in its unfolded configuration, and in which each folded elongated strip is folded in alternating directions along a plurality of fold lines that are diagonally oriented with respect to the longitudinal axis to provide a series of alternating faceted surfaces. When a unit structure comprises two or more side-by-side adjacent folded elongated strips, neighboring strips may be fixed to each other, for example, using brackets. The brackets may lock the angles between the adjacent faceted surfaces.

The module may further include at least two support attachment brackets on the top side for attaching the module to a support structure, each support attachment bracket having an inverted Y-configuration (a "Y-bracket") with a top upwardly extending plate section in a first plane and two bottom sections downwardly extending therefrom in the first plane (forming, in part, the two bottom arms of the inverted Y) and from each bottom section extending in the first plane a module attachment plate segment extending therefrom in plane transverse to the first plane at an angle selected so that the module attachment plate segment rests in a flush manner on a faceted surface of one folded strip of the module for the first arm and the module attachment plate segment of the other arm rests in a flush manner on a faceted surface of the other folded strip of the module. The module attachment plate segments may each have one or more holes formed there-through for screw attachment to the folded strips of the module. The upwardly extending top plate section of each of the support attachments may, for example, have at least one hole formed therein so that the bracket can be fastened to a support structure using a fastener inserted through the hole, such as a screw/bolt screwed into the support structure.

Alternatively, or in addition, the support structure and the top plate section of the support attachment bracket may be mutually sized and configured to reversibly attach the Y-bracket to the support structure by a spring locking mechanism. For example, the top upwardly extending plate section of the Y-bracket may include a laterally protruding tab on each side (extending within the first plane) that can be physically captured by the spring locking mechanism.

Another embodiment of the invention provides an architectural fixture that includes at least one architectural fixture module as described that includes at least a first and a second support attachment Y-bracket each having at least one through hole formed in the top upwardly extending plate section of the bracket; and a support structure comprising a rib/strut laterally presenting a first threaded recess mutually sized and configured to align with the at least one hole formed in the top plate section of the first support attachment bracket and a second threaded recess sized and configured to simultaneously align with the at least one hole formed in the top plate section of the second support attachment bracket; a screw fastener screw inserted through the at least one hole formed in the top plate section of the first support attachment Y-bracket bracket into the first threaded recess; and a screw fastener screw inserted through the at least one hole formed in the top plate section of the second support attachment Y-bracket bracket into the second threaded recess, whereby the architectural fixture module is securably fixed to the rib/strut of the support structure.

A further embodiment of the invention provides an architectural fixture that includes at least one architectural fixture module as described that includes a support attachment Y-bracket having laterally protruding tabs as described; and a support structure comprising a rib/strut having a slot formed in a bottom side that is sized and configured to receive the upwardly extending top plate section and a spring capture mechanism mutually sized and configured with the tabs to physically prevent the upwardly extending top plate section from being removed from the slot, wherein the upwardly extending top plate section is inserted into the slot so that lateral tabs physically prevent the upwardly extending top plate section from being removed from the slot.

The spring capture mechanism may, for example, include at each end of the slot a flat spring disposed on the back side of the slot that partially laterally extends over the slot, whereby the flat spring can pushed upward by the tabs until it passes downward to rest at the back side of the slot abutting the side of the top plate below the tabs so that the tabs come to rest on the springs.

The invention also provides methods of manufacturing the fixture modules, fixtures and brackets of the invention.

This brief summary has been provided so that the nature of the invention may be understood quickly. Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE DRAWINGS

The various present embodiments now will be discussed in detail with an emphasis on highlighting the advantageous features with reference to the drawings of various embodiments. The illustrated embodiments are intended to illustrate, but not to limit the invention. These drawings include the following figures, in which like numerals indicate like parts:

FIGS. 5A-5H illustrate various steps of a method for folding and arranging a pair of strips into a faceted unit assembly (fin assembly);

FIGS. 17A-17H illustrate various steps of a method for folding and arranging a pair of strips into a faceted unit assembly (fin assembly);

DETAILED DESCRIPTION OF THE INVENTION

Figure 1:
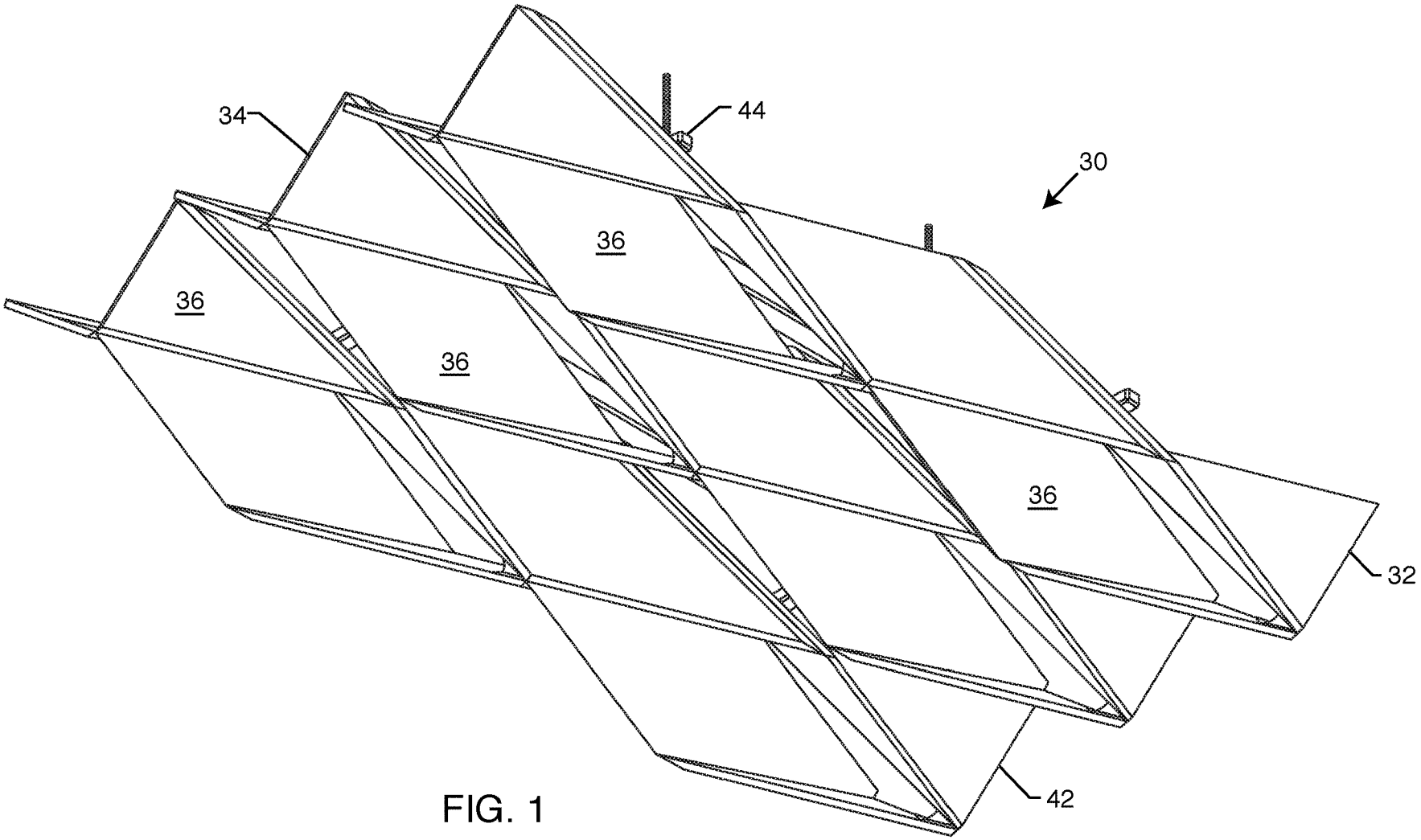
FIG. 1 illustrates a bottom-side isometric view of a modular ceiling fixture embodying the invention.
Figure 2:
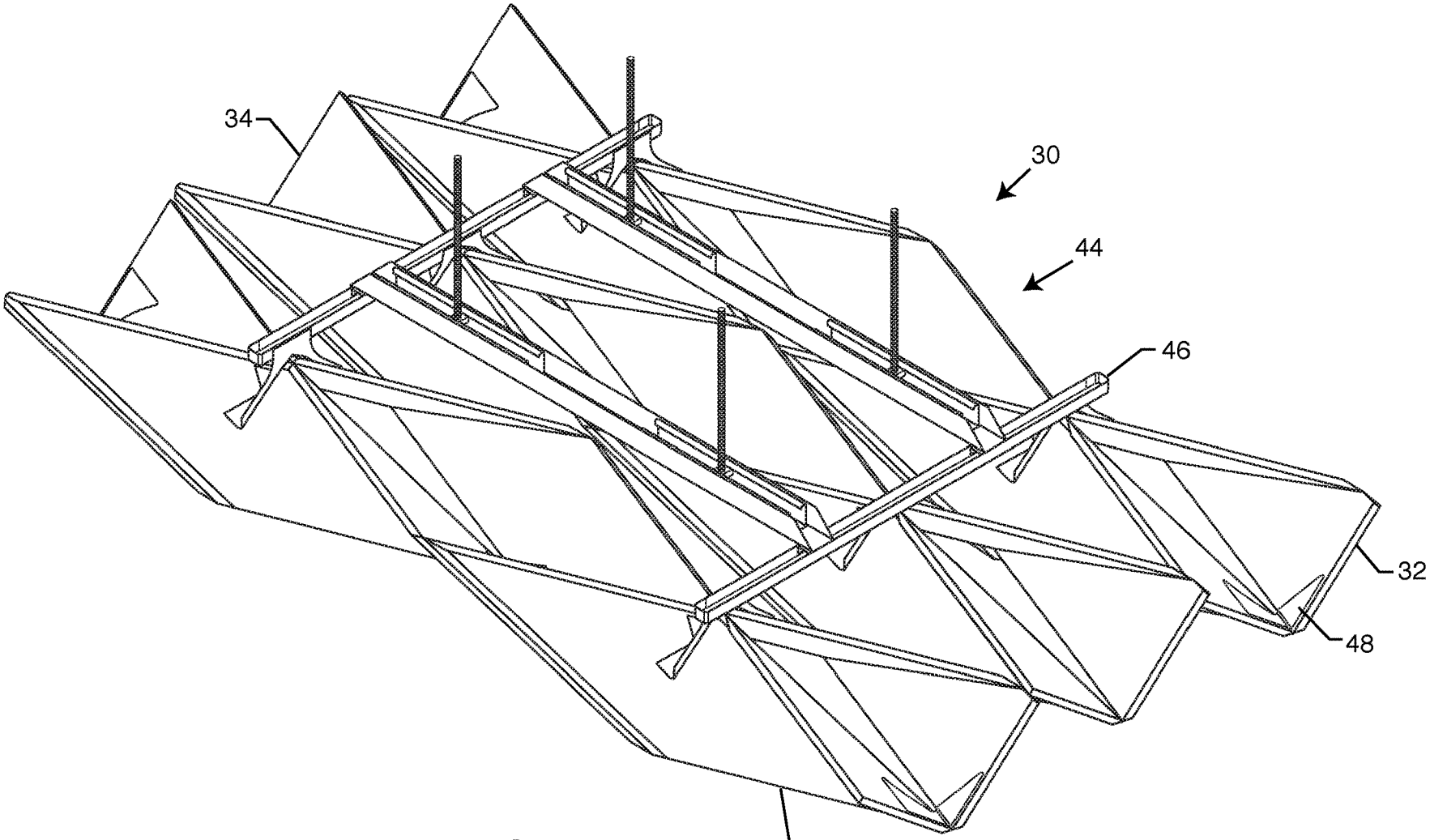
FIG. 2 is a top-side isometric view of the embodiment of FIG. 1 in which the mounting and joining hardware of the fixture is shown.
Figure 3:
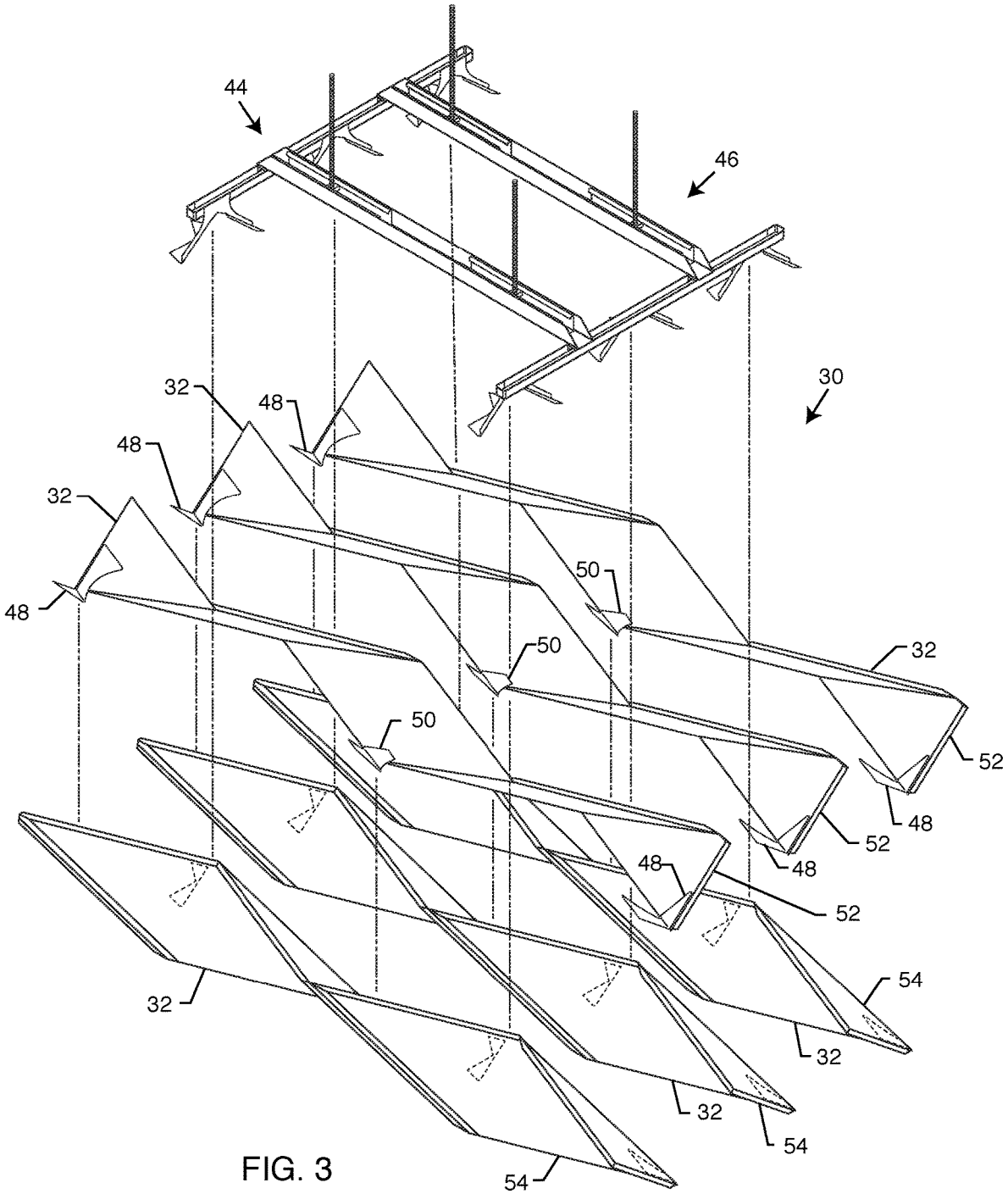
FIG. 3 is a partially exploded top-side isometric view of the fixture embodiment of FIG. 1 in which the strips are shown detached from each other and the mounting hardware components.
Figure 4:
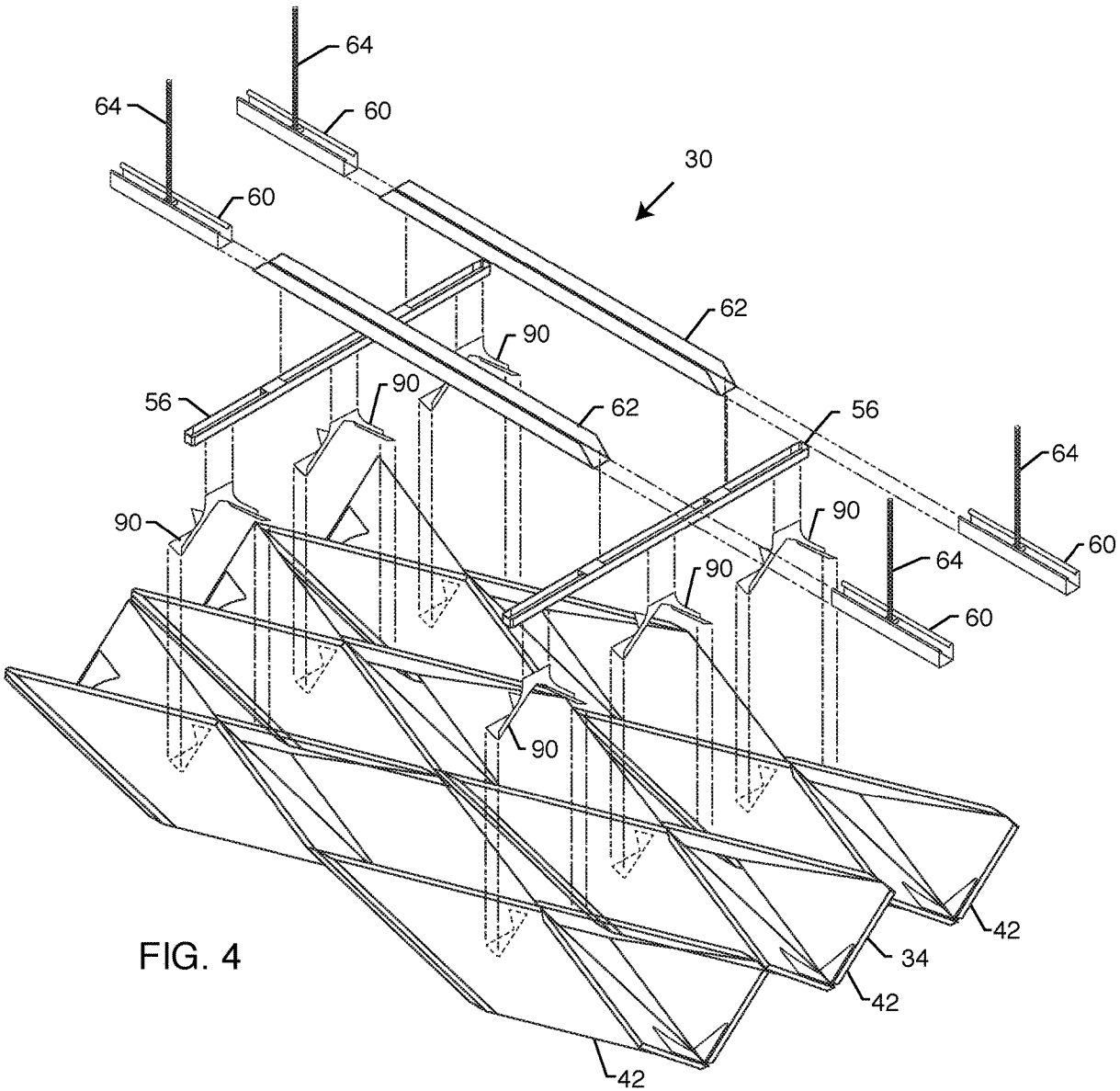
FIG. 4 is a partially exploded top-side isometric view of the fixture embodiment of FIG. 1 in which the mounting hardware components are shown in an exploded view and the strips are shown separately in their as-mounted configuration.
Figure 6:
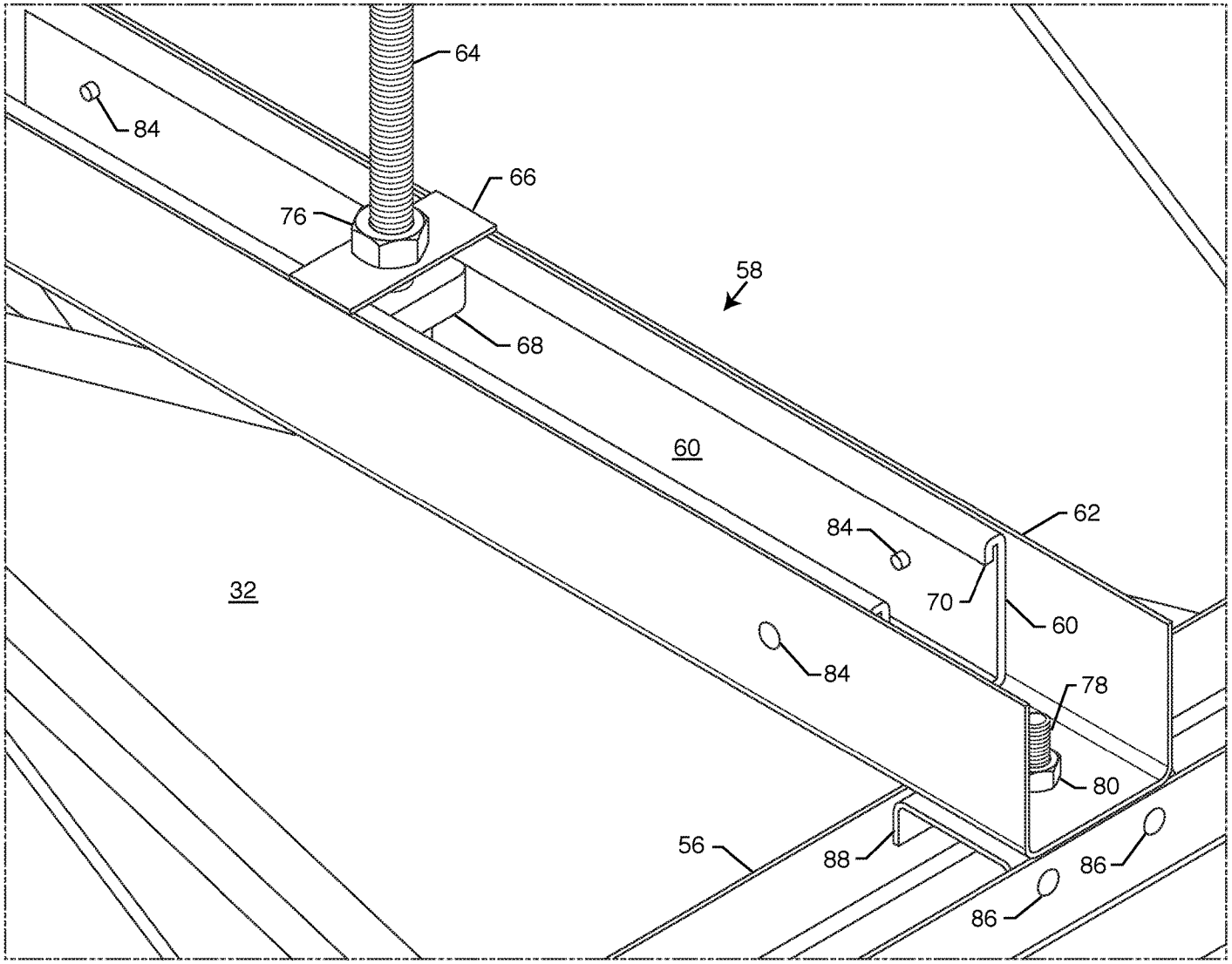
FIG. 6 illustrates a top-side isometric view of a portion of the support structure assembly of the embodiment of FIG. 1.
Figure 7:
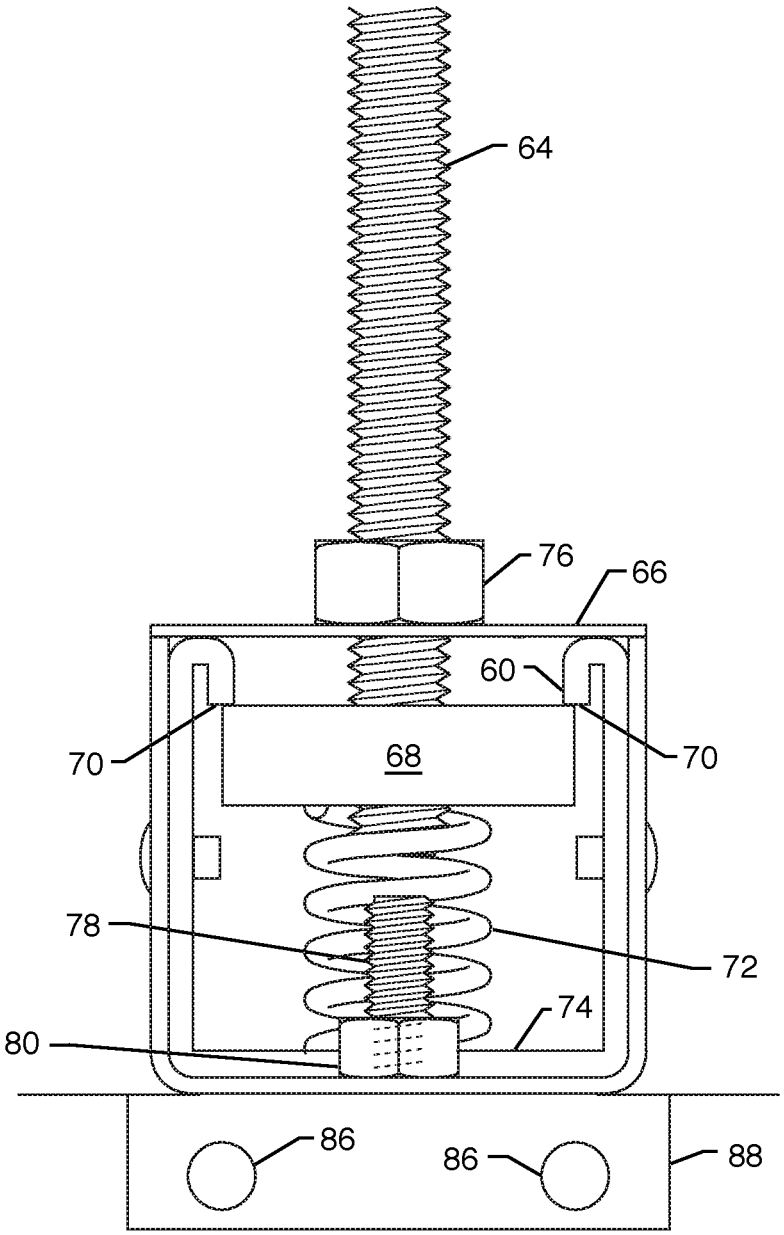
FIG. 7 illustrates a view of a unistrut component of the support structure assembly of the embodiment of FIG. 1.

The following detailed description describes the present embodiments, with reference to the accompanying drawings, with FIGS. 1-25 illustrating architectural fixture assemblies that include one or more folded elongated strips, such as a plurality of adjacent folded elongated strips, each strip providing a series of alternating faceted surfaces. The following detailed description further describes methods for manufacturing, arranging, mounting, and joining the folded strips as well as specialized hardware components therefor. In the drawings, reference numbers label elements of the present embodiments. These reference numbers are reproduced below in connection with the discussion of the corresponding drawing features.

FIGS. 1-12 illustrate an embodiment of a modular architectural faceted fixture assembly 30 that includes one or more folded elongated strips 32. The assembly 30 includes a module 34 comprising a plurality of adjacent folded elongated fins or strips 32 (or, in the alternative, just a single strip 32), each fin or strip 32 providing a series of alternating faceted surfaces 36. The module 34 includes three (3) adjacent pairs of folded strips 32 in which each pair includes two (2) identically folded strips 32 arranged counter-directionally (in an anti-parallel configuration) and joined to each other.

The strips 32 may be made using one or more sound-absorbing/barrier (acoustical) materials including, but not limited to, fabric-covered synthetic polymer foam, fabric-covered glass wool composite material, or the like. In the alternative, the folded strips 32 may also be formed from a metallic sheet, a polymeric sheet, or the like. Metallic sheets, for example, may be pressed or bent into the required folded shape by various methods known in the art. To assist in bending, perforation lines can be made in the metallic sheet. Polymeric sheet stock, for example, may be pressed/bent under heating to obtain the required shape. Polymeric strips having the required folded shape, for example, may also be molded such as by injection molding directly into the required folded fin shape.

The strips 32 may be elongated with a longitudinal axis and parallel sides along said axis. The strips 32 may be folded in alternating directions along sequential fold lines 38 that may be parallel to each other and diagonally oriented with respect to the longitudinal axis of the strips 32.

For material having a substantial thickness, a v-cut 40 may be made along the back side of the fold lines 38 on the strip 32 so that the strip 32 may cleanly fold without substantially compressing or deforming the material of the strip 32 that is otherwise present along the fold line 38. Most, such as all, of the strips 32 used to make a panel may be folded in at least substantially the same way, such as in the same way. For a single folded elongated strip 32, the fold angles may, for example, be locked into place using various means including, without limitation, brackets, fasteners and/or adhesives (either alone or in various combination with one or more of each other). For strips 32 having substantial thickness, the v-cuts 40 may be configured to permit the exposed edges to abut in a flush manner when the strip sections are folded at a desired angle. The abutting edges may, for example, be joined using an adhesive (e.g., an epoxy or the like).

As seen in FIGS. 5A-5G, a portion of a strip 32, shown in an unfolded configuration in FIGS. 5A and 5B, includes a plurality of fold lines 38 (four (4) fold lines 38 are seen in this particular embodiment) along a length of the strip 32 that define where the strip 32 is to be folded so as to provide the faceted surfaces 36 of the fixture assembly 30. The number of fold lines 38 may vary depending on the number of faceted surfaces 36 desired per each strip 32. To facilitate folding, the surface of the strip 32 along the fold lines 38 may be scored with a knife or other cutting device. When the material of the strip 32 has a substantial thickness, the v-cuts 40 may be made generally along the fold lines 38 to facilitate folding of the strip 32 so as to provide the faceted surfaces 36 of the fixture assembly 30. The thickness of the material of the strip 32 can range from about ⅛" to about 1" (preferably about 0.5"), but could be thinner or thicker. The v-cut 40, in particular, clears material out of the cut to allow for an inward fold. It should be kept in mind that folding cuts work because a slight skin remains that keeps the material together. Alternatively, a cut formed by a slit made in the material of the strip 32 could be used to fold material away from the cut. The term "v-cut" is used for illustrative purposes only, and there are other cuts that could be made to do essentially the same thing (i.e., removes material and aids in folding). When the strip 32 does not have a substantial thickness, the strip 32 may simply be folded along the fold lines 38. FIG. 5C shows folding of the strip 32 along the first fold, with FIG. 5D shows folding of the strip 32 along the second fold, FIG. 5E showing folding of the strip 32 along the third fold, and FIG. 5F showing folding of the strip 32 along fourth fold (i.e., the final fold in this embodiment). Another strip 32 may be folded in a similar manner, with the first and second identically folded strips arranged side by side in opposite directions (in an anti-parallel configuration) with this pair of strips 32 joined together to form a unit or fin assembly 42, as seen in FIG. 5G and FIG. 5H. Alternatively, the unit or fin assembly 42 may be formed using two or more folded strips 32 arranged side-by-side with parallel longitudinal axes (of the folded strips 32) and the folded strips 32 alternating directions (so that the second strip 32 is one hundred eighty (180) degrees rotated with respect to the first strip 32, the third strip 32 in the same direction as the first strip 32 but one hundred eighty (180) degrees rotated with respect to the second strip 32, and so on). Strips 32 oriented in one direction may be designated as "Strip Type A" or "Fin Type A" strips 52 while strips 32 oriented one hundred eighty (180) degrees rotated with respect to the "Strip Type A" or "Fin Type A" strips 52 may be designated as "Strip Type B" or "Fin Type B" strips 54. A "Strip Type A" or "Fin Type A" strip 52 may be placed side-by-side and adjacent to a "Strip Type B" or "Fin Type B" strip 54 and attached to each other, for example, using various means including, without limitation, brackets and/or fasteners and/or adhesives (either alone or in various combinations with one or more of each other), to form the unit or fin assembly 42 that can be hung from or mounted to a surface (not shown) or a support structure assembly 44 (for example, a support structure assembly 44 includes a rib/strut assembly 46 engaging). The fold angles and configuration of the folded strips 32 may be locked into position when two folded strips 32 are joined to each other at multiple attached locations by using various means including, but not limited to, brackets and/or fasteners and/or adhesives (either alone or in various combinations with one or more of each other). The brackets may be sized and configured so as to join the surfaces of each of the two adjacent strips 32 of a pair to which it is fastened at predetermined points at predetermined angles. For example, ends of adjacent strips 32 may be joined by end brackets 48 and at the center by center brackets 50.

A plurality of these units (or fin assemblies) 42 may be mounted side-by-side to a surface (not shown) or support structure assembly 44 to form a faceted fixture assembly 30. Additional units 42 and/or faceted fixture assemblies 30 may be disposed in side-to-side and/or end-to-end configurations to provide coverage of a desired area (e.g., a ceiling, a wall, a floor, etc.).

As discussed above, the support structure assembly 44 includes a rib/strut assembly 46. The rib/strut assembly 46 comprises a pair of ribs 56 engaging a pair of strut assemblies 58. Each strut assembly 58 comprises a pair of unistruts 60 sized and shaped to be received within a channel of a unistrut sleeve 62, wherein each unistrut 60 is disposed on opposite sides of the unistrut sleeve 62. Each unistrut 60 mechanically engages the unistrut sleeve 62 of the strut assembly 58, and is held therein. One end of a threaded rod 64 is used to engage the unistrut 60 to the unistrut sleeve 62 while the other end of the threaded rod 64 is used to engage the support structure assembly 44, and by extension the entire assembly 30, to a surface (e.g., ceiling, wall, floor, etc.). The threaded rod 64 engages a unistrut 60 to the unistrut sleeve 62 by extending through a hole in a washer plate 66 (the washer plate 66 being disposed on top of and directly contacting the unistrut 60 and the unistrut sleeve 62) and through a threaded bore of a channel nut 68 which engages upper ends 70 of the unistrut 60 (the upper ends 70 being folded inwardly and facing downward into a channel of the unistrut 60). A spring coil 72, disposed between a channel floor 74 of the unistrut 60 and the bottom surface of the channel nut 68, is used to bias the channel nut 68 against the ends 70 of the unistrut 70. A nut 76 is used to bias the washer plate 66 against the tops of the unistrut 60 and unistrut sleeve 62. Rivets 84 passing through the sides of the unistrut 60 and unistrut sleeve 62 are also used to connect the unistrut 60 to the unistrut sleeve 62.

Each rib 56 includes a pair of carriages 88 spaced apart along the length of the rib 56. Each carriage 88 includes a threaded carriage bolt 78. Each unistrut sleeve 62 includes a hole (not shown) on each end through which a particular carriage bolt 78 passes. Each carriage bolt 78 is secured in position by a threaded nut 80. Rivets 86 passing through the sides of the carriage 88 and the rib 56 are also used to connect the rib 56 to the unistrut sleeve 62.

Figure 8:
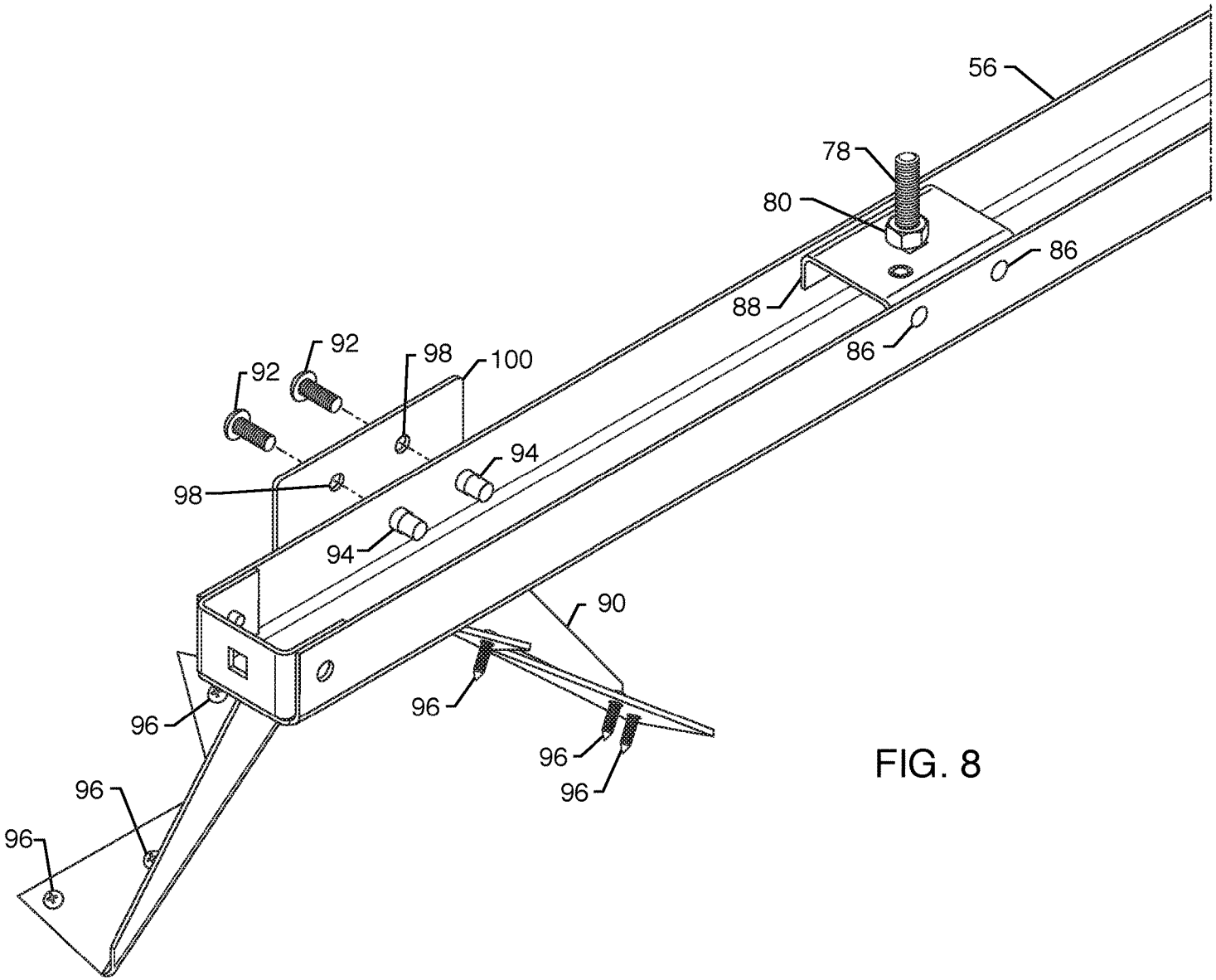
FIG. 8 illustrates engagement of a support attachment Y-bracket to a rib of the support structure assembly.

FIG. 8 illustrates attachment of a support attachment Y-bracket 90 (having holes 98 formed through the top plate segment 100) to a particular rib 56 of the support structure assembly 44 using fasteners such as threaded bolts/screws 92 and rivet nuts 94. The Y brackets 90 engage each unit or fin assembly 42 to the support structure assembly 44. Two holes (not shown) are formed in one side of the U-shaped rib 56 of the support structure assembly. Rivet nuts 94 with internal threads are securably disposed in the holes (not shown). The corresponding holes 98 on the Y-bracket 90 are aligned with the holes (not shown) formed in the rib 56 and the threaded bolts/screws 92 are screw inserted through the holes 98 in the Y-bracket 90 into the internally threaded rivet nuts 94 to secure the Y bracket 90 and the underlying unit or fin assembly 42 to the support structure assembly 44. The number of ribs 56 and Y brackets 90 used in any particular embodiment may vary. Screws 96 pass through portions of each Y bracket 90 to connect the Y-brackets to the strips 32.

Figure 9:
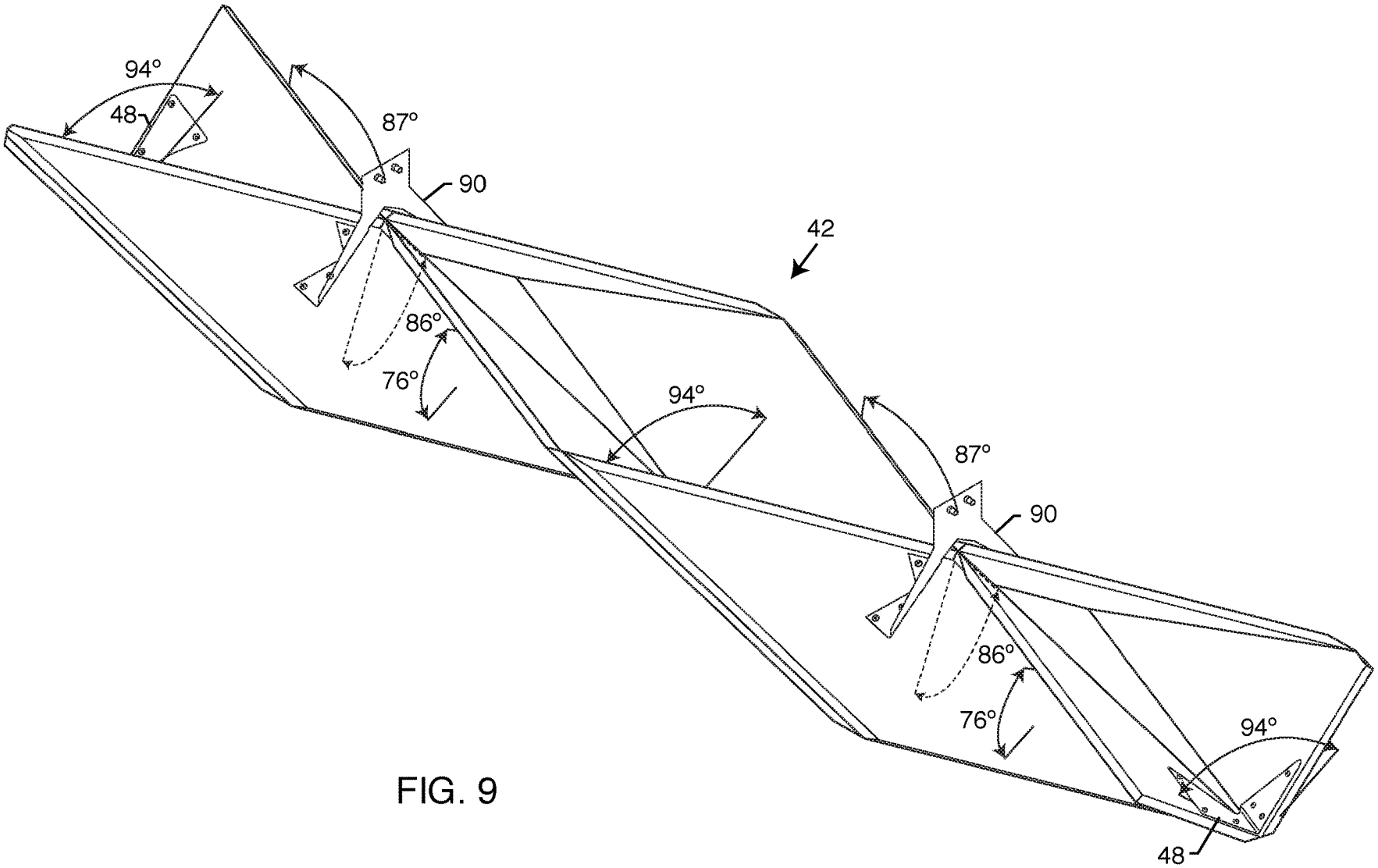
FIG. 9 illustrates an isometric view of a faceted unit assembly (fin assembly), similar to that seen in FIG. 5H.

FIG. 9 shows a faceted unit or fin assembly 42 including two counter-directionally oriented, folded fins or strips 32 joined to each other and locked into the illustrated angles by coupling brackets 48, 50 and further joined to at least two bolt-on type Y-brackets 90. The angles are illustrate only and may vary depending on the angle of the folded lines 38 and the type of cut, if any, made into the surface of a particular strip 32 along the folded lines 38. As seen, the particular angles vary between seventy (70) degrees to one hundred one (101) degrees, but the strips 32 could be folded at different angles, as desired.

Figure 10:
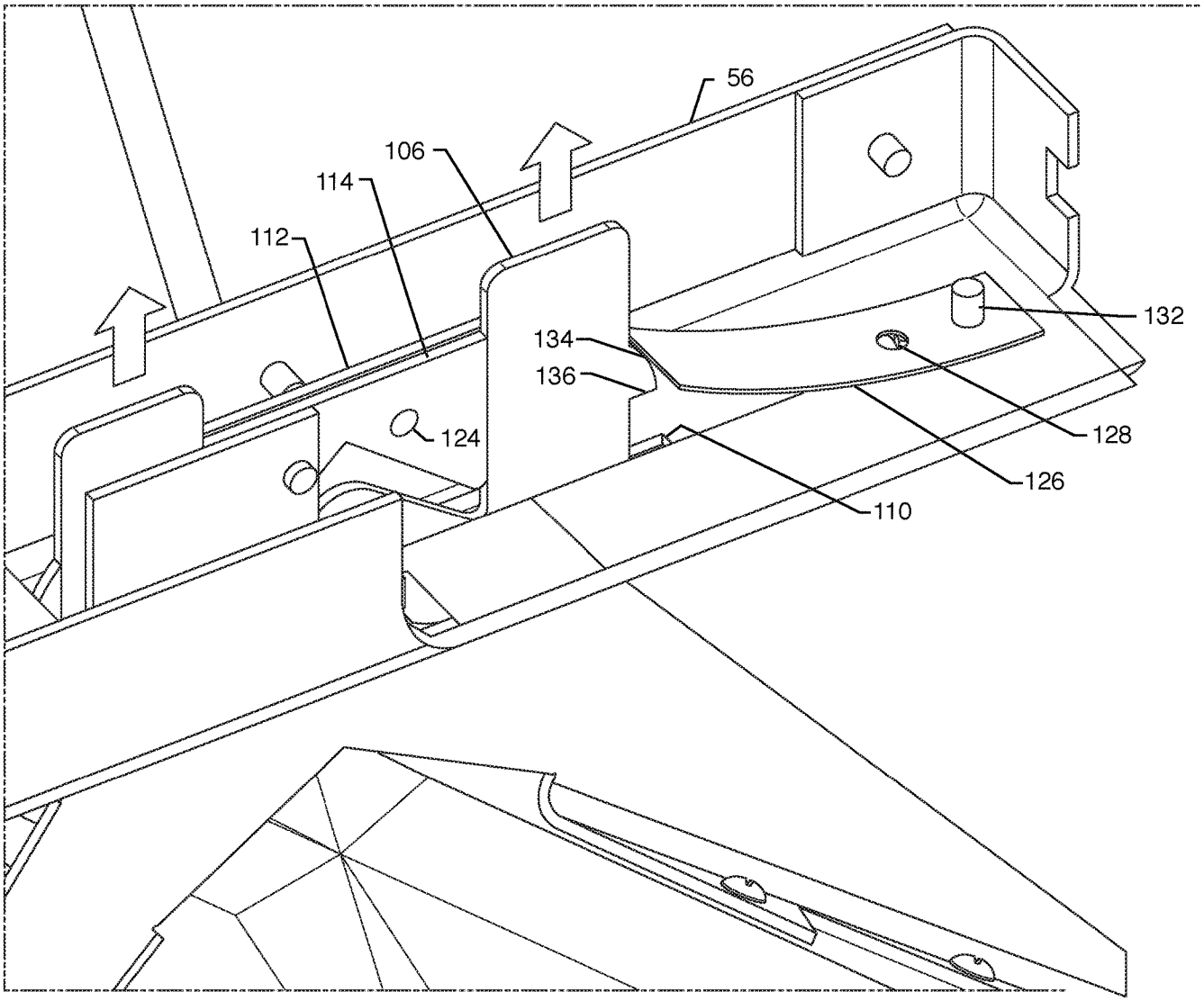
FIG. 10 illustrates an embodiment of a guided spring clip assembly of the support structure assembly engaging an embodiment of a Y-bracket coupler attached to the top side of a faceted unit assembly.
Figure 11A:
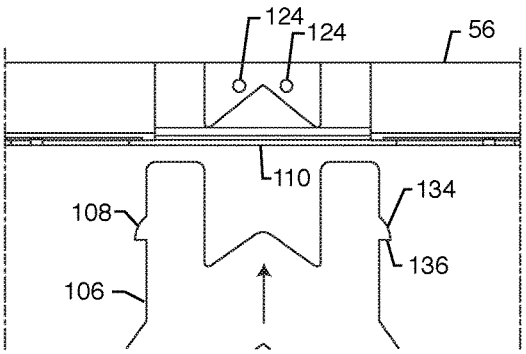
FIGS. 11A-11D illustrate steps for engaging a faceted unit assembly to the support structure assembly.
Figure 11B:
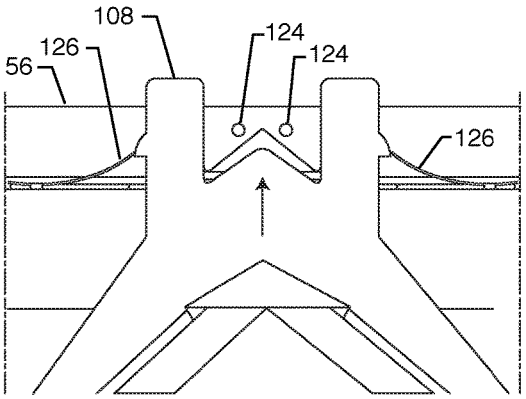
Figure 11C:
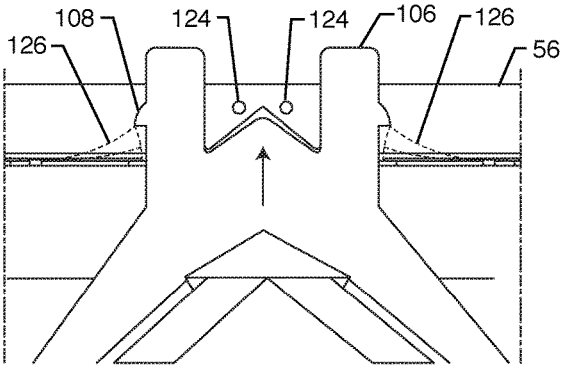
Figure 11D:
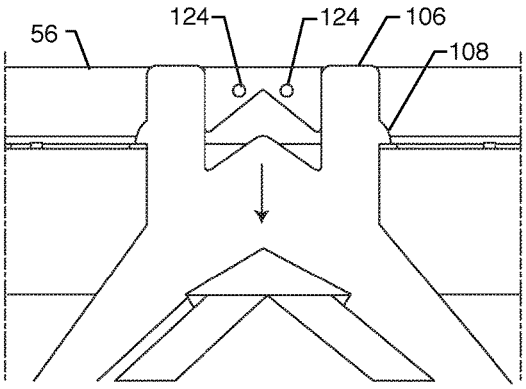
Figure 12:
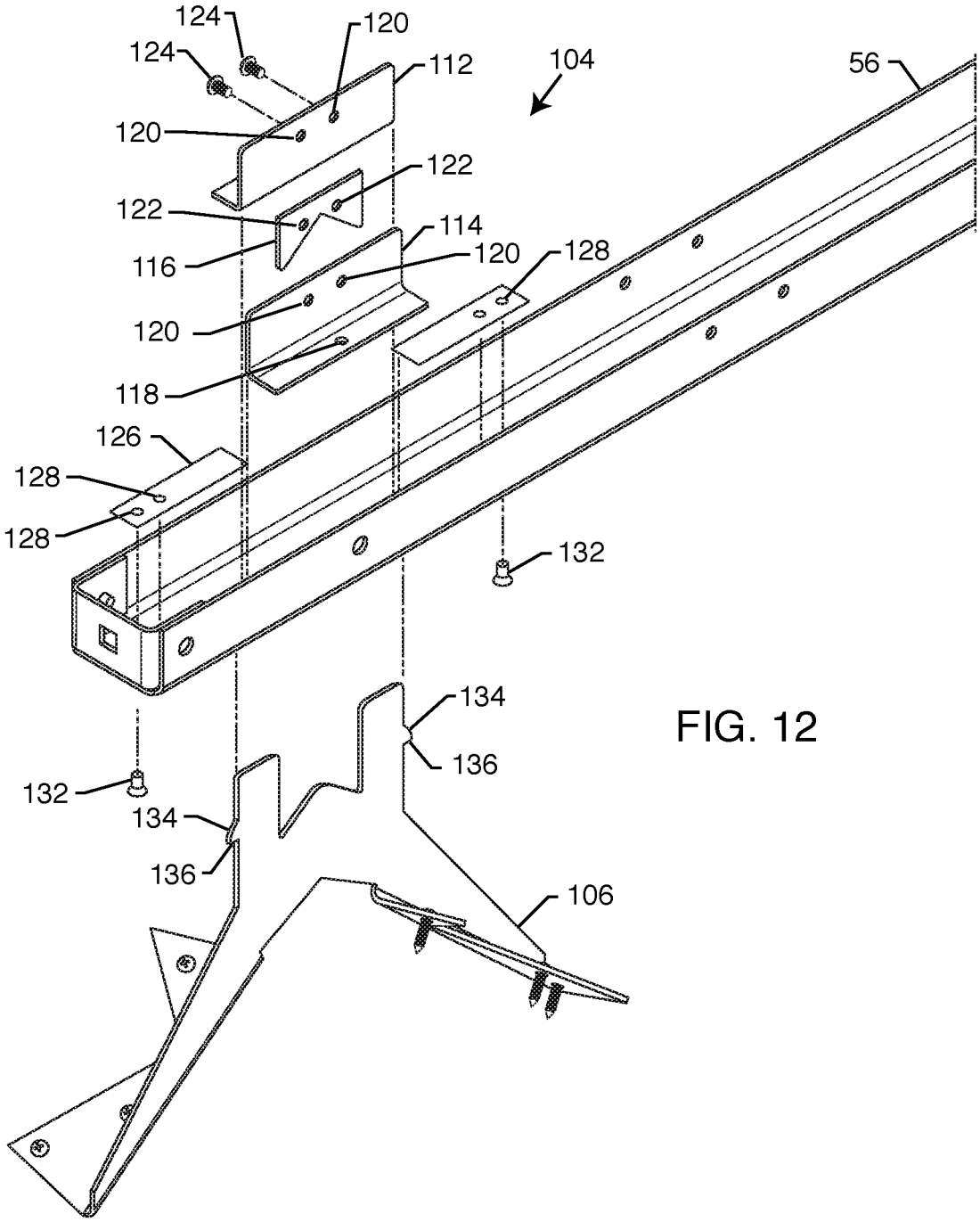
FIG. 12 is an exploded view illustrating components of the guided spring clip assembly of the support structure assembly and a mutually sized and configured Y-bracket coupler.
Figure 13:
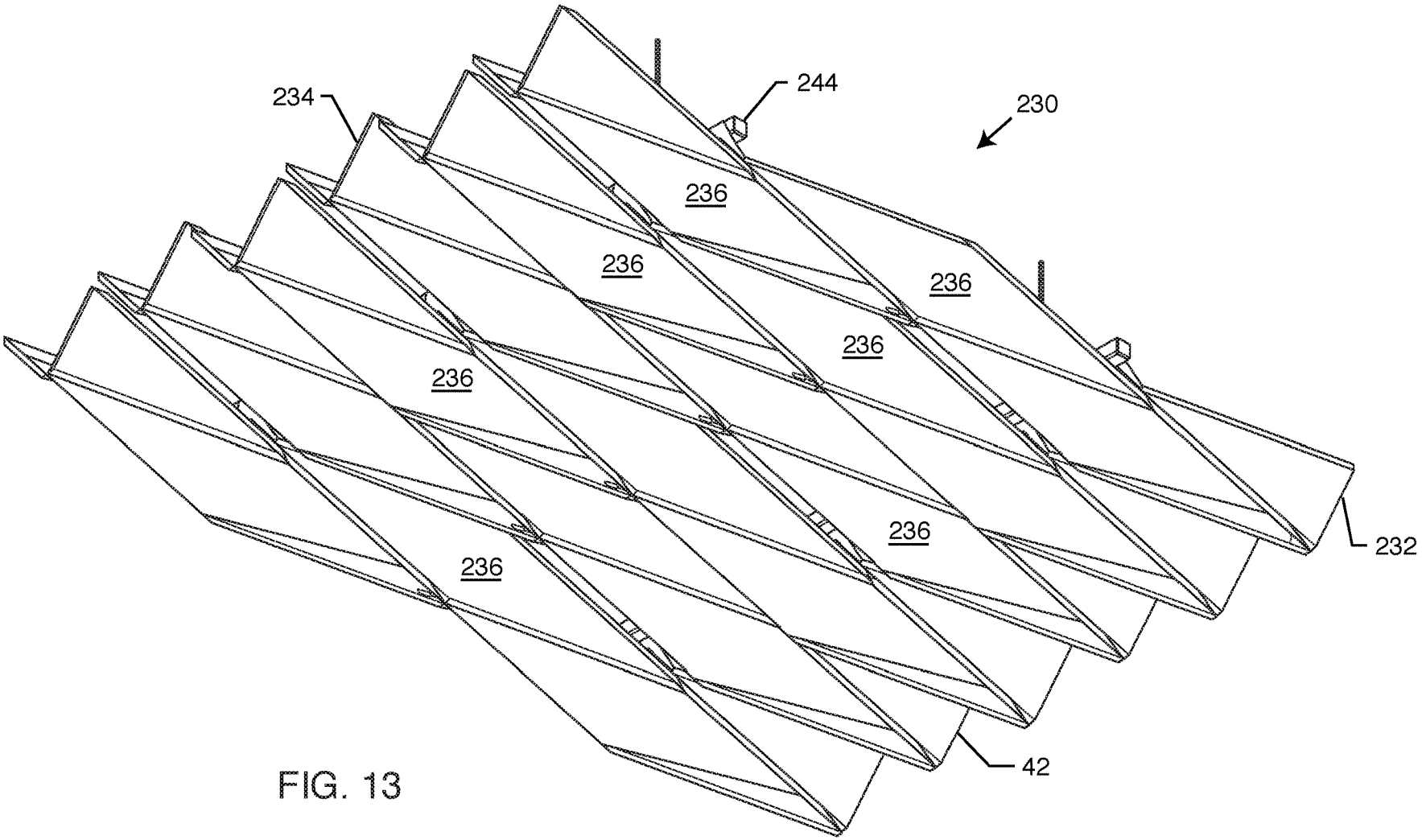
FIG. 13 illustrates a bottom-side isometric view of another embodiment of a modular ceiling fixture.
Figure 14:
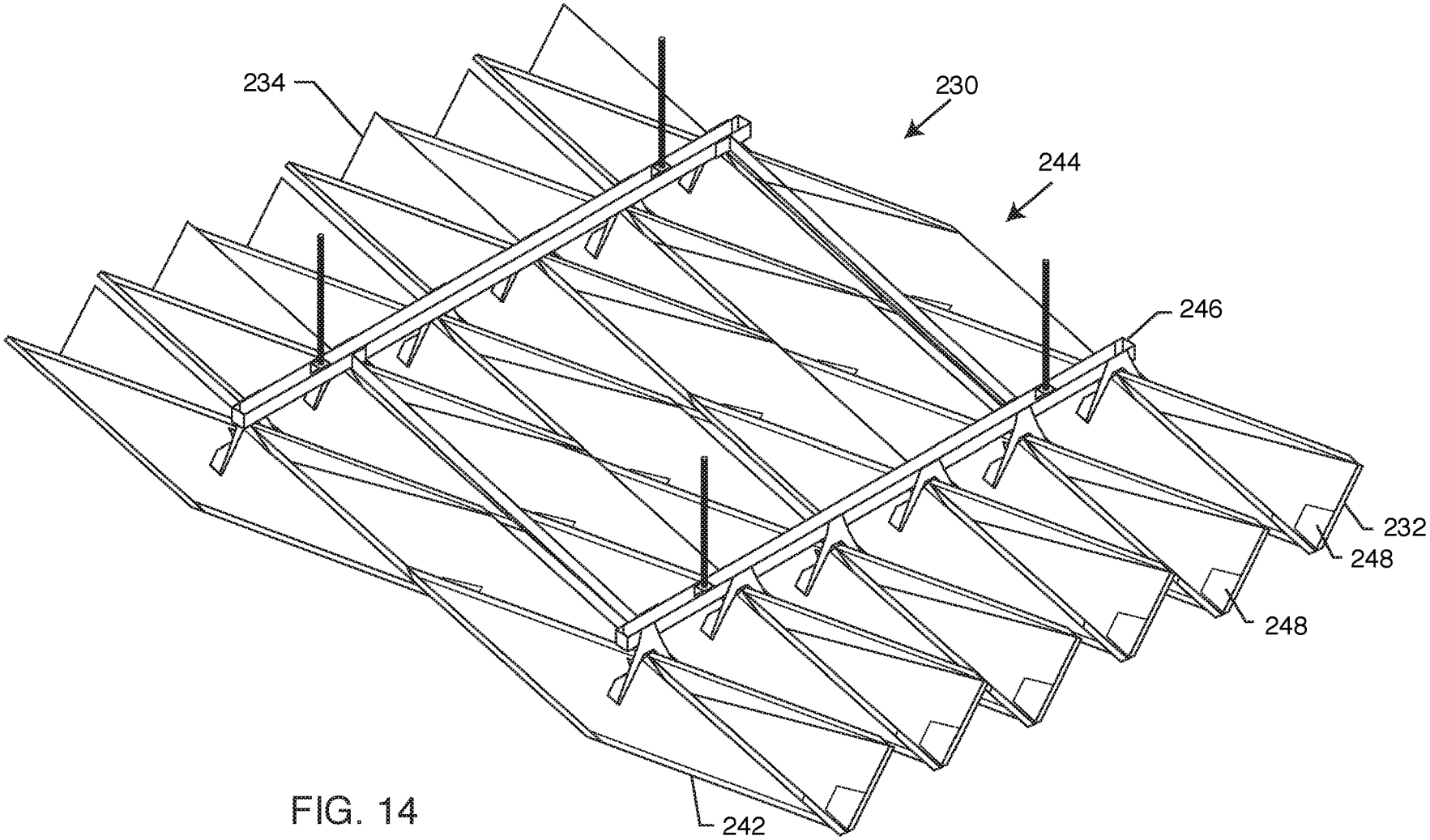
FIG. 14 is a top-side isometric view of the embodiment of FIG. 13 in which the mounting and joining hardware of the fixture is shown.
Figure 15:
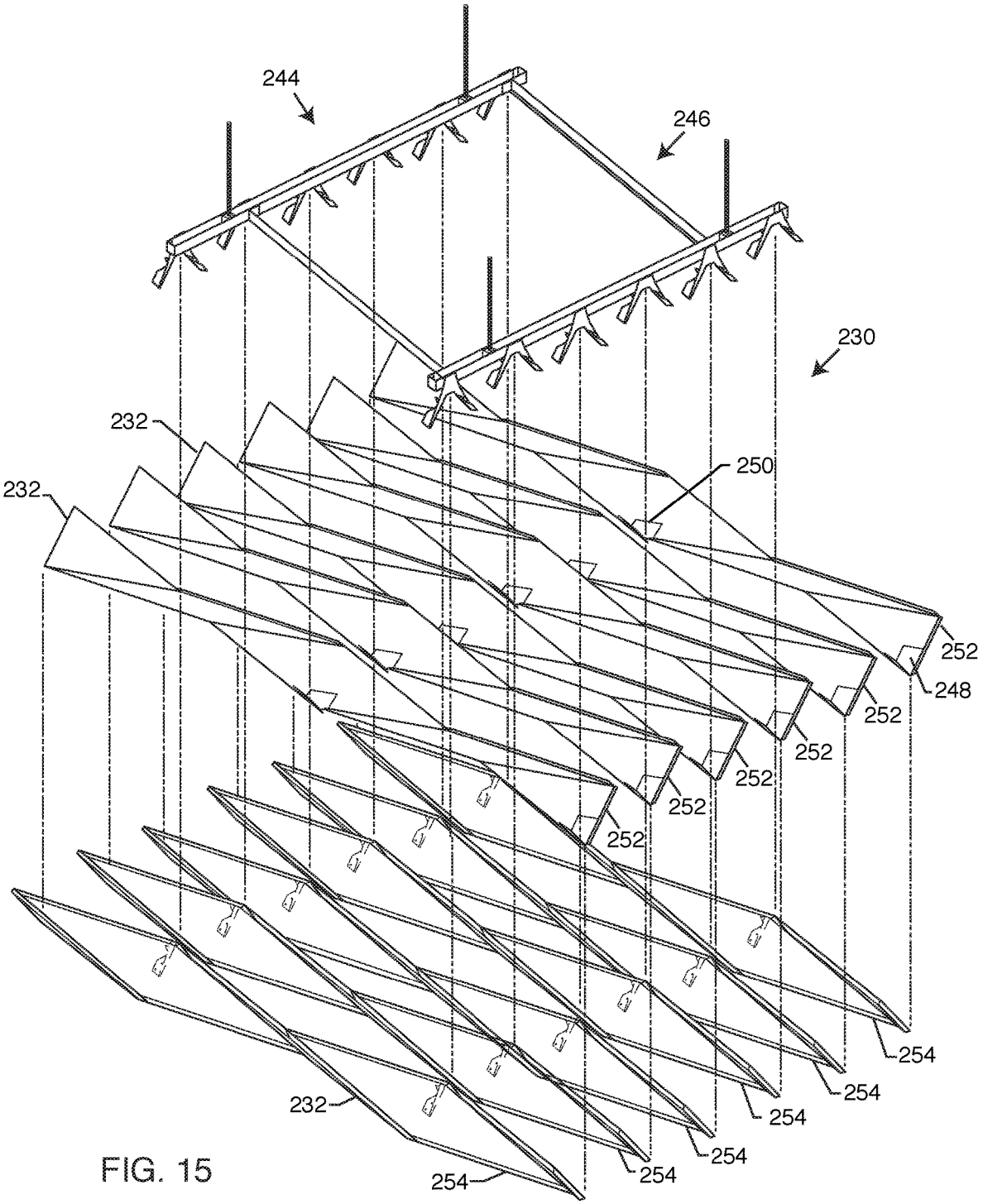
FIG. 15 is a partially exploded top-side isometric view of the fixture embodiment of FIG. 13 in which the strips are shown detached from each other and the mounting hardware components.
Figure 16:
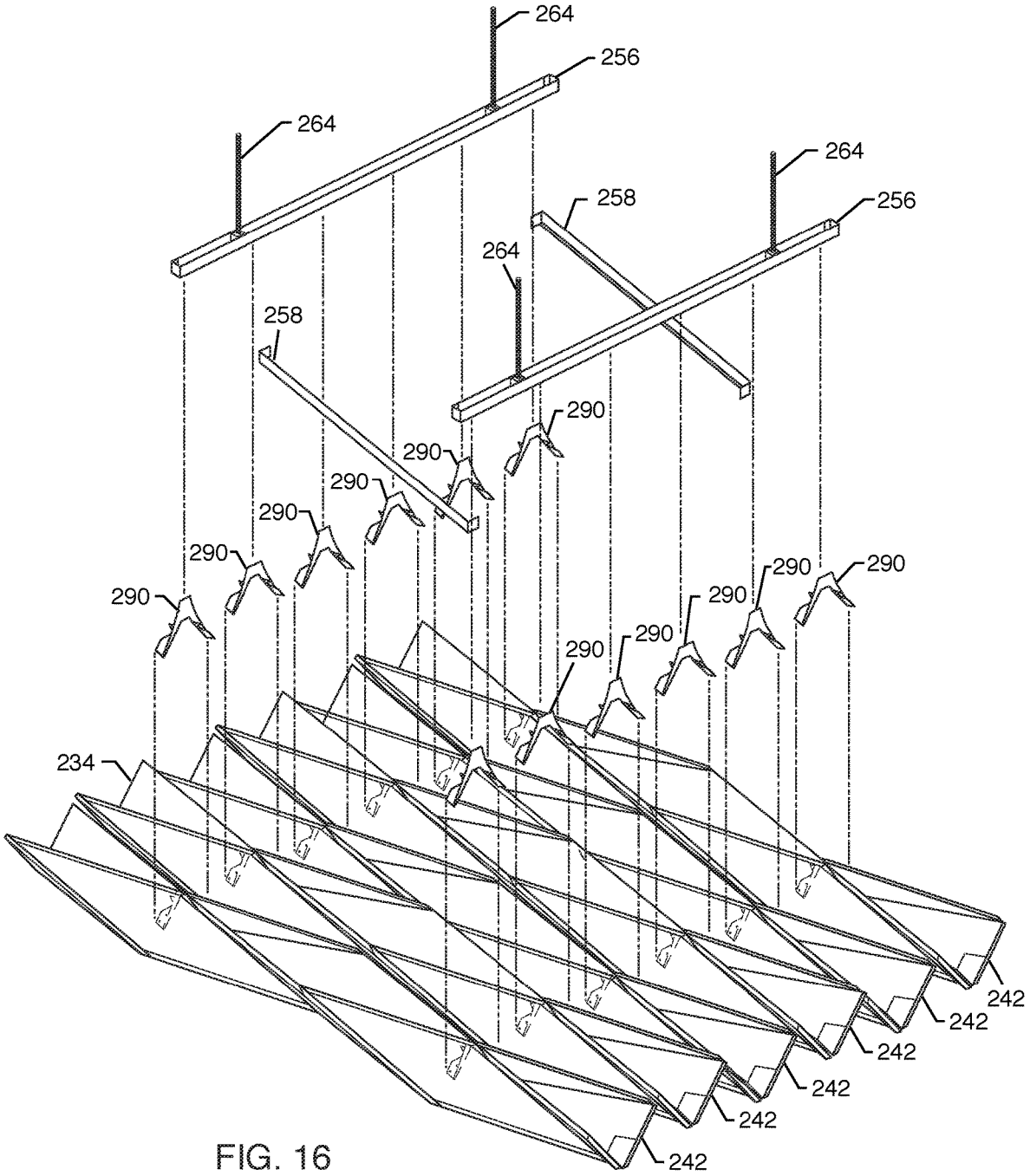
FIG. 16 is a partially exploded top-side isometric view of the fixture embodiment of FIG. 13 in which the mounting hardware components are shown in an exploded view and the strips are shown separately in their as-mounted configuration.
Figure 18:
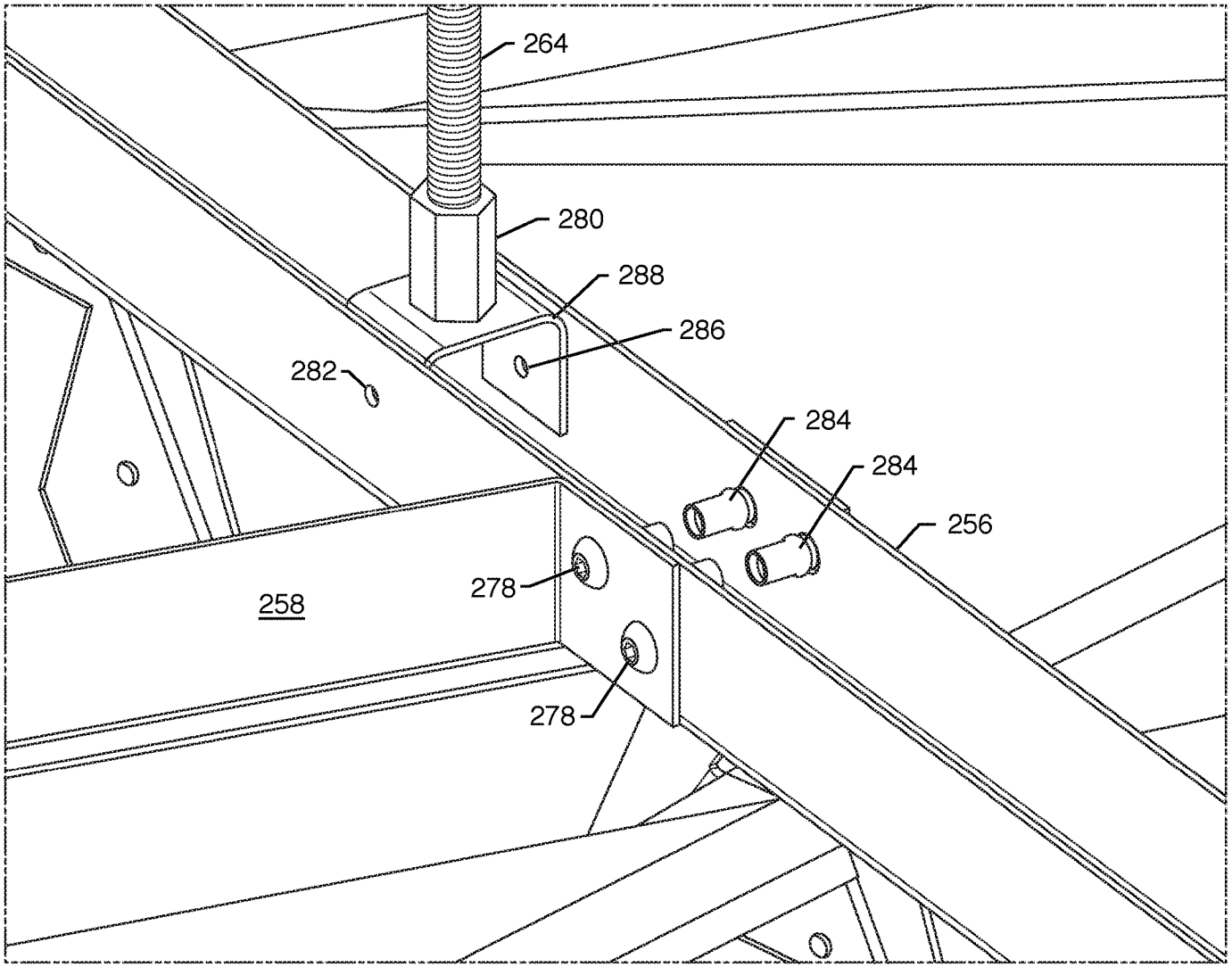
FIG. 18 illustrates a top-side isometric view of a portion of the support structure assembly of the embodiment of FIG. 13.
Figure 19:
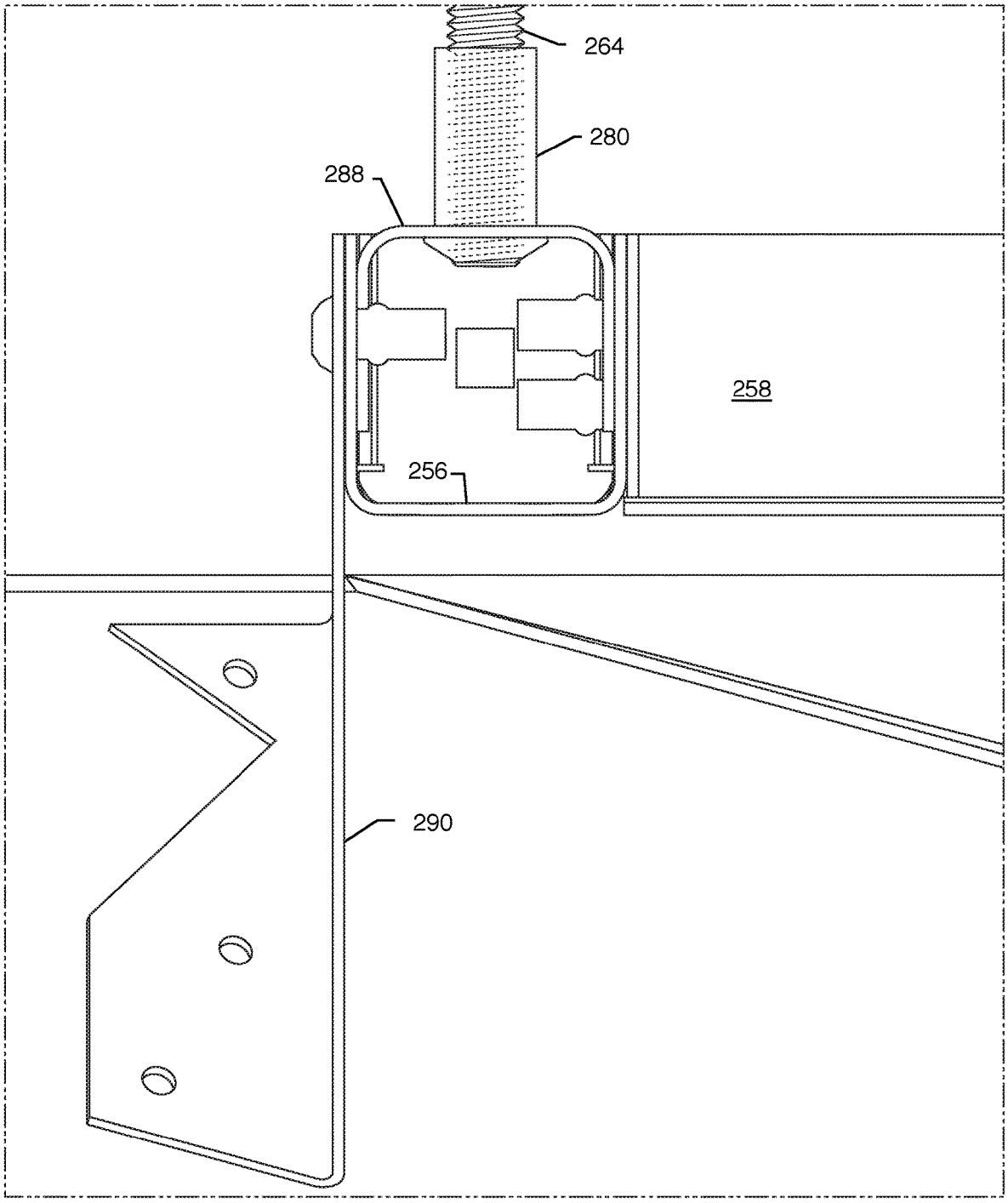
FIG. 19 illustrates a view of a unistrut component of the support structure assembly of the embodiment of FIG. 13.

FIGS. 10-12 illustrate an alternative mechanism for engaging each unit or fin assembly 42 to the support structure assembly 44. In this alternative, a guided spring clip mechanism 104 is used to couple a Y-bracket 106 (attached to the top side of a faceted unit or fin assembly 42) to the support structure assembly 44. Laterally protruding tabs 108 of the Y-bracket 106 are received by the guided spring clip mechanism 104 of the support structure assembly 44.

FIGS. 11A-11D illustrate the stepwise mechanism involved in the spring-clip mechanism 104 coupling a faceted unit or fin assembly 42 to the support structure assembly 44 by inserting the Y-bracket 106 having the laterally protruding tabs 108 into a rib slot 110 formed in a bottom of a rib 56 of the support structure assembly 44. The spring-clip mechanism 104 comprises two L brackets 112, 114 and a spacer having an inverted-V cutout 116. Each of the L brackets 112, 114 includes a hole 118 used to connect the L bracket 112, 114 to the rib 56. The spacer 116 is disposed between the two L brackets 112, 114. Each L bracket 112, 114 includes a pair of holes 120 that are aligned with each other as well as aligned with a pair of holes 122 on the spacer 116. Rivets 124 extend through the holes 120, 122 and connect the L brackets 112, 114 and spacer 116 to each other. The spacer 116 is positioned directly above the rib slot 110. The Y bracket 106 includes an upper portion having a cut-out sized and shaped to match the spacer 116 so as to receive the spacer 116 therein. A pair of resilient tabs 126 are connected to the rib 56, each tab 126 disposed on an opposite side of the brackets 112, 114 from the other tab 126. The tabs 126 may be made from a variety of resilient materials including, without limitation, spring steel, plastic, carbon fiber, or the like. Each tab 126 comprises a flat spring. Each tab 126 includes at least two holes 128 located towards the end of the tab 126 furthest from the L brackets 112, 114. One of the holes 128 of each tab 126 is aligned with a particular one of one or more holes (not shown) extending through the rib 56. A rivet 132 extends through the hole 128 of the tab 126 and hole (not shown) of the rib 56 and connects the tab 126 to the rib 56. A free end of the tab 126 can bend upwards with the amount of bend depending on the material the tab 126 is constructed from and which hole(s) 128 is used to connect the tab 126 to the rib 56 (bending of tabs 126 can be seen in phantom lines in FIG. 11C). The closer the hole 128 is to the L brackets 112, 114, the more force is required to bend the tab 126 upwards.

In use, the spring-clip mechanism 104 engages the Y bracket 106 to the rib 56 by guiding the top of the Y bracket 106 into and through the rib slot 110. The laterally protruding tabs 108 of the Y bracket 106 each have an upper surface 134 that curves downwardly, and a lower horizontal surface 136. As the Y bracket 106 is pushed into and through the slot 110, the tabs 126 engage the upper surfaces 134 of the tabs 108 and bend upwardly. The Y bracket 106 is pushed further upwardly until it collides with the spacer 116 such that the spacer 116 is received within the cut-out of the upper portion of the Y bracket 106 sized and shaped to receive the spacer 116 therein. Before the Y bracket 106 receives the spacer 116 within the cut-out of the upper portion of the Y bracket 106, the upper surfaces 134 of the tabs 108 will move past and disengage from the tabs 126, causing the tabs 126 to fall back into place. At that point, the Y bracket 106 is retracted downwards until the horizontal surfaces 136 of the tabs 108 collide with and engage a top surface of the tabs 126, preventing any further downward movement of the Y bracket 106, and locking the unit or fin assembly 42 into engagement with the support structure assembly 44.

FIGS. 13-21 illustrate another embodiment of a modular architectural faceted fixture assembly 230 that includes one or more folded elongated strips 232. The assembly 230 includes a module 234 comprising a plurality of adjacent folded elongated fins or strips 232 (or, in the alternative, just a single strip 232), each fin or strip 232 providing a series of alternating faceted surfaces 236. The module 234 includes six (6) adjacent pairs of folded strips 232 in which each pair includes two (2) identically folded strips 232 arranged counter-directionally (in an anti-parallel configuration) and joined to each other.

The strips 232 may be made using one or more sound-absorbing/barrier (acoustical) materials including, but not limited to, fabric-covered synthetic polymer foam, fabric-covered glass wool composite material, or the like. In the alternative, the folded strips 232 may also be formed from a metallic sheet, a polymeric sheet, or the like. Metallic sheets, for example, may be pressed or bent into the required folded shape by various methods known in the art. To assist in bending, perforation lines can be made in the metallic sheet. Polymeric sheet stock, for example, may be pressed/bent under heating to obtain the required shape. Polymeric strips having the required folded shape, for example, may also be molded such as by injection molding directly into the required folded fin shape.

The strips 232 may be elongated with a longitudinal axis and parallel sides along said axis. The strips 232 may be folded in alternating directions along sequential fold lines 238 that may be parallel to each other and diagonally oriented with respect to the longitudinal axis of the strips 232.

For material having a substantial thickness, a v-cut 240 may be made along the back side of the fold lines 238 on the strip 232 so that the strip 232 may cleanly fold without substantially compressing or deforming the material of the strip 232 that is otherwise present along the fold line 238. Most, such as all, of the strips 232 used to make a panel may be folded in at least substantially the same way, such as in the same way. For a single folded elongated strip 232, the fold angles may, for example, be locked into place using various means including, without limitation, brackets, fasteners and/or adhesives (either alone or in various combination with one or more of each other). For strips 232 having substantial thickness, the v-cuts 240 may be configured to permit the exposed edges to abut in a flush manner when the strip sections are folded at a desired angle. The abutting edges may, for example, be joined using an adhesive (e.g., an epoxy or the like).

As seen in FIGS. 17A-17G, a portion of a strip 232, shown in an unfolded configuration in FIGS. 17A and 17B, includes a plurality of fold lines 238 (four (4) fold lines 238 are seen in this particular embodiment) along a length of the strip 232 that define where the strip 232 is to be folded so as to provide the faceted surfaces 236 of the fixture assembly 230. The number of fold lines 238 may vary depending on the number of faceted surfaces 236 desired per each strip 232. To facilitate folding, the surface of the strip 232 along the fold lines 238 may be scored with a knife or other cutting device. When the material of the strip 232 has a substantial thickness, the v-cuts 240 may be made generally along the fold lines 238 to facilitate folding of the strip 232 so as to provide the faceted surfaces 236 of the fixture assembly 230. The thickness of the material of the strip 232 can range from about ⅛" to about 1" (preferably about 0.5"), but could be thinner or thicker. The v cut 240, in particular, clears material out of the cut to allow for an inward fold. It should be kept in mind that folding cuts work because a slight skin remains that keeps the material together. Alternatively, a cut formed by a slit made in the material of the strip 232 could be used to fold material away from the cut. The term "v-cut" is used for illustrative purposes only, and there are other cuts that could be made to do essentially the same thing (i.e., removes material and aids in folding). When the strip 232 does not have a substantial thickness, the strip 232 may simply be folded along the fold lines 238. FIG. 17C shows folding of the strip 232 along the first fold, with FIG. 17D shows folding of the strip 232 along the second fold, FIG. 17E showing folding of the strip 232 along the third fold, and FIG. 17F showing folding of the strip 232 along fourth fold (i.e., the final fold in this embodiment). Another strip 232 may be folded in a similar manner, with the first and second identically folded strips arranged side by side in opposite directions (in an anti-parallel configuration) with this pair of strips 232 joined together to form a unit or fin assembly 242, as seen in FIGS. 17G and 17H. Alternatively, the unit or fin assembly 242 may be formed using two or more folded strips 232 arranged side-by-side with parallel longitudinal axes (of the folded strips 232) and the folded strips 232 alternating directions (so that the second strip 232 is one hundred eighty (180) degrees rotated with respect to the first strip 232, the third strip 232 in the same direction as the first strip 232 but one hundred eighty (180) degrees rotated with respect to the second strip 232, and so on). Strips 232 oriented in one direction may be designated as "Strip Type A" or "Fin Type A" strips 252 while strips 232 oriented one hundred eighty (180) degrees rotated with respect to the "Strip Type A" or "Fin Type A" strips 252 may be designated as "Strip Type B" or "Fin Type B" strips 254. A "Strip Type A" or "Fin Type A" strip 252 may be placed side-by-side and adjacent to a "Strip Type B" or "Fin Type B" strip 254 and attached to each other, for example, using various means including, without limitation, brackets and/or fasteners and/or adhesives (either alone or in various combinations with one or more of each other), to form the unit or fin assembly 242 that can be hung from or mounted to a surface (not shown) or a support structure assembly 244 (for example, a support structure assembly 244 includes a rib/strut assembly 246 engaging). The fold angles and configuration of the folded strips 232 may be locked into position when two folded strips 232 are joined to each other at multiple attached locations by using various means including, but not limited to, brackets and/or fasteners and/or adhesives (either alone or in various combinations with one or more of each other). The brackets may be sized and configured so as to join the surfaces of each of the two adjacent strips 232 of a pair to which it is fastened at predetermined points at predetermined angles. For example, ends of adjacent strips 232 may be joined by end brackets 248 and at the center by center brackets 250.

A plurality of these units (or fin assemblies) 242 may be mounted side-by-side to a surface (not shown) or support structure assembly 244 to form a faceted fixture assembly 230. Additional units 242 and/or faceted fixture assemblies 230 may be disposed in side-to-side and/or end-to-end configurations to provide coverage of a desired area (e.g., a ceiling, a wall, a floor, etc.).

As discussed above, the support structure assembly 244 includes a rib/strut assembly 246. The rib/strut assembly 246 comprises a pair of ribs 256 engaging a pair of struts 258. One end of a threaded rod 264 is used to engage one of the ribs 256 while the other end of the threaded rod 264 is used to engage the support structure assembly 244, and by extension the entire assembly 230, to a surface (e.g., ceiling, wall, floor, etc.). The threaded rod 264 engages a carriage 288 connected to one of the ribs 256. Each carriage 288 includes a hole (not shown) through which a rivet nut 280 with internal threads passes, wherein the rivet nut 280 receives and threadedly engages an end of the threaded rod 264. Rivets (not shown) passing through aligned holes 286, 282 in the sides of the carriage 288 and the rib 256 to connect the carriage 288 with the rib 256.

Each strut 258 engages both ribs 256. Each rib 256 includes two pairs of holes (not shown), with each pair of holes aligning with a pair of holes (not shown) on the end of each strut 258 facing that rib 256. A pair of bolts 278 passes through the aligned pairs of holes to connect a particular strut 258 to a particular rib 256. Each bolt 278 is secured in position by a threaded nut 284.

Figure 20:
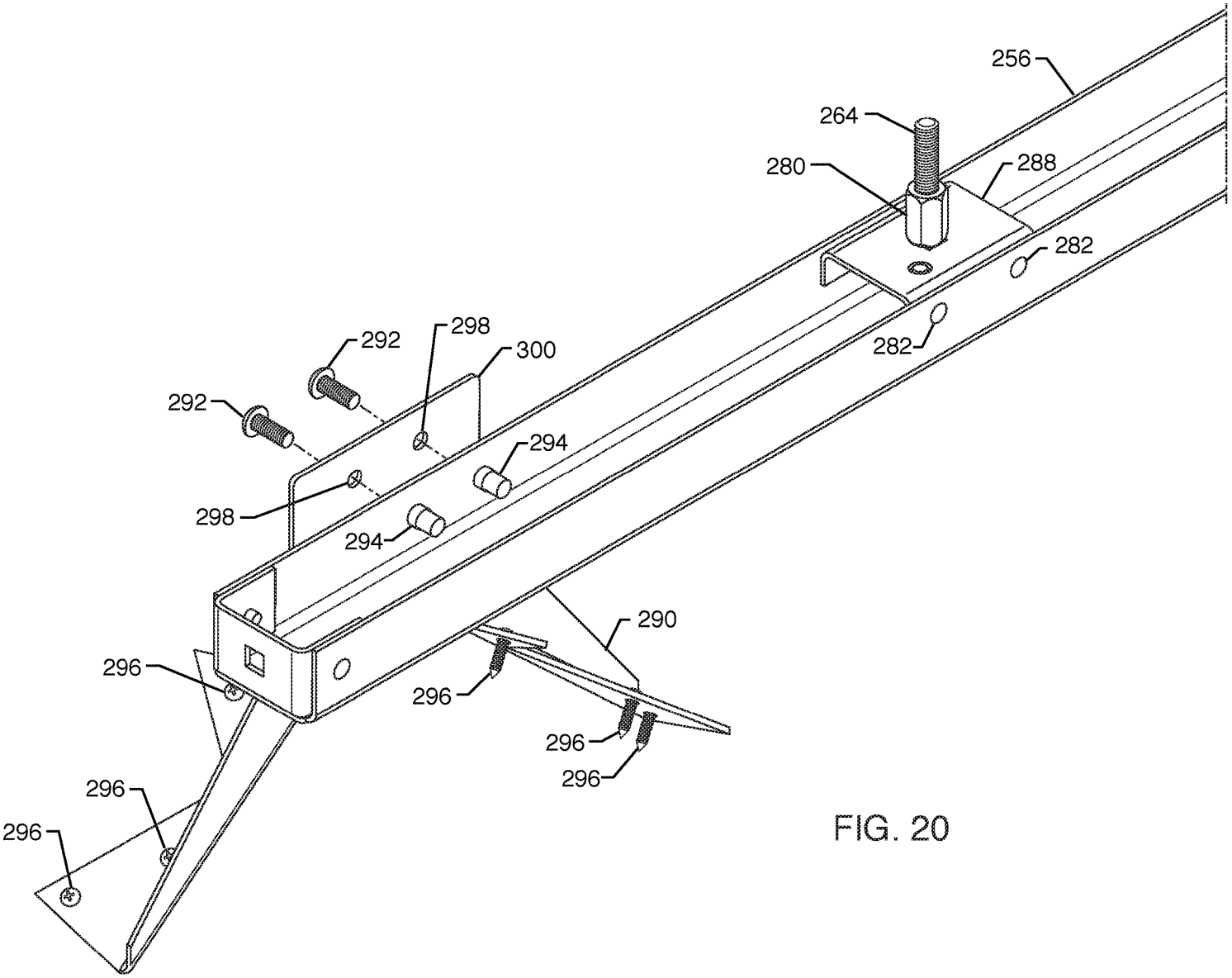
FIG. 20 illustrates engagement of a support attachment Y-bracket to a rib of the support structure assembly.

FIG. 20 illustrates attachment of a support attachment Y-bracket 290 (having holes 298 formed through the top plate segment 300) to a particular rib 256 of the support structure assembly 244 using fasteners such as threaded bolts/screws 292 and rivet nuts 294. The Y brackets 290 engage each unit or fin assembly 242 to the support structure assembly 244. Two holes (not shown) are formed in one side of the U-shaped rib 256 of the support structure assembly. Rivet nuts 294 with internal threads are securably disposed in the holes (not shown). The corresponding holes 298 on the Y-bracket 290 are aligned with the holes (not shown) formed in the rib 256 and the threaded bolts/screws 292 are screw inserted through the holes 298 in the Y-bracket 290 into the internally threaded rivet nuts 294 to secure the Y bracket 290 and the underlying unit or fin assembly 242 to the support structure assembly 244. The number of ribs 256 and Y brackets 290 used in any particular embodiment may vary. Screws 296 pass through portions of each Y bracket 290 to connect the Y-brackets 290 to the strips 232.

Figure 21:
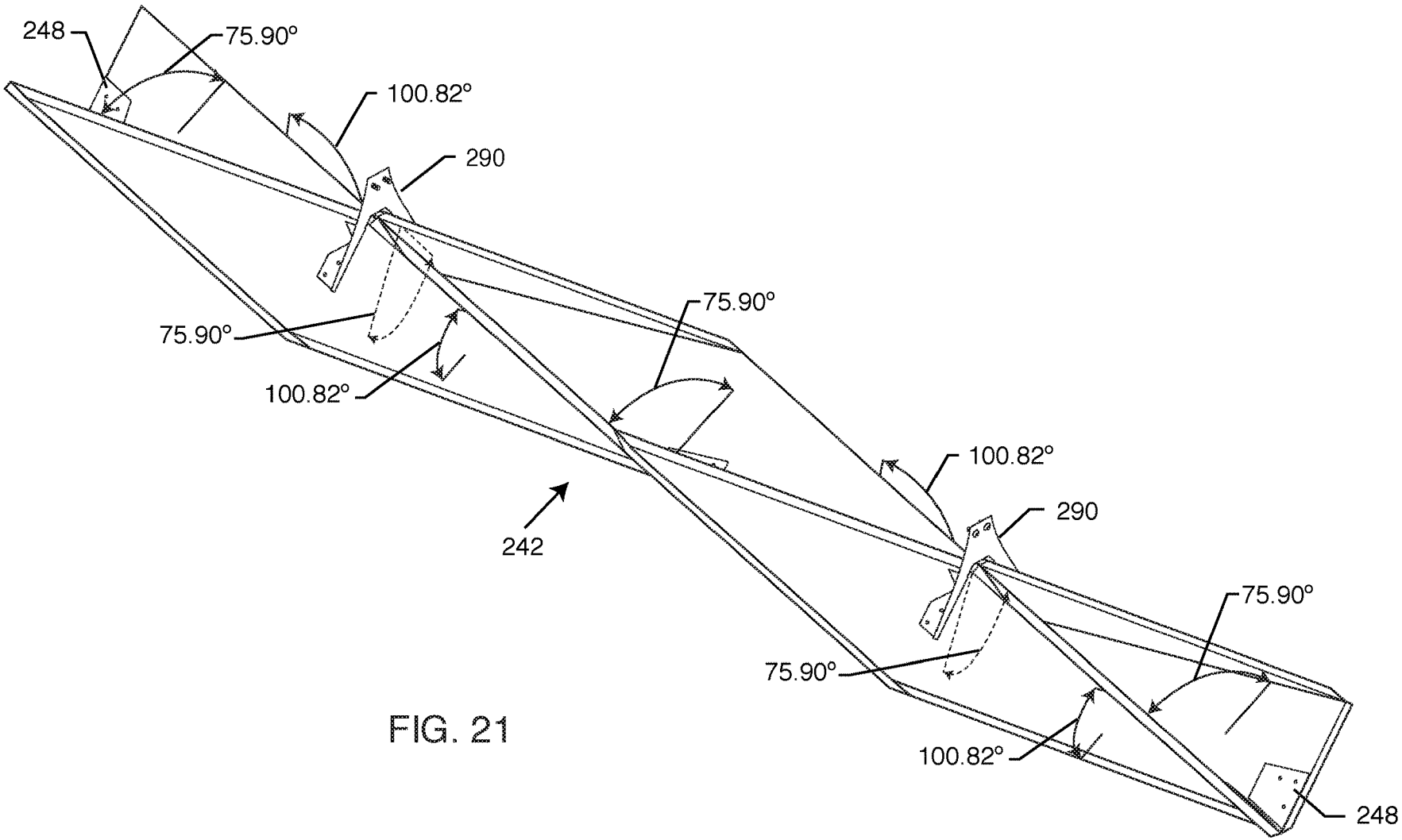
FIG. 21 illustrates an isometric view of a faceted unit assembly (fin assembly), similar to that seen in FIG. 17H.

FIG. 21 shows a faceted unit or fin assembly 242 including two counter-directionally oriented, folded fins or strips 232 joined to each other and locked into the illustrated angles by coupling brackets 248, 250 and further joined to at least two bolt-on type Y-brackets 290. The angles are illustrative only and may vary depending on the angle of the folded lines 238 and the type of cut, if any, made into the surface of a particular strip 232 along the folded lines 238. As seen, the particular angles vary between seventy (70)

degrees to one hundred one (101) degrees, but the strips 232 could be folded at different angles, as desired.

Figure 22A:
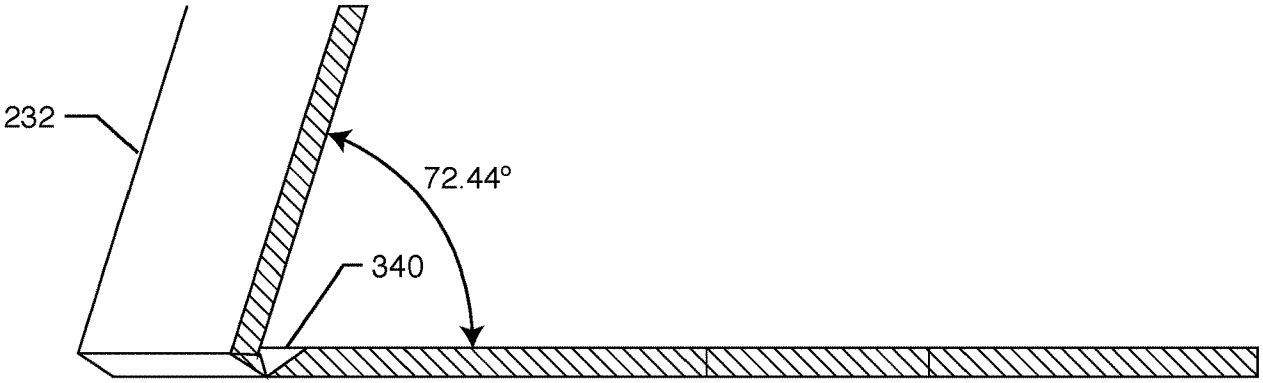
FIGS. 22A and 22B illustrate side views of a folded and unfolded strip having double-v cuts along fold lines.
Figure 22B:
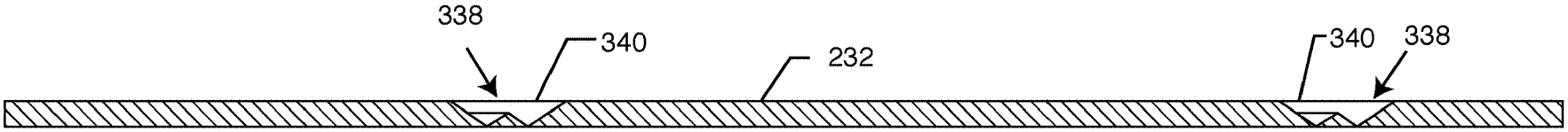

FIGS. 22A and 22B illustrate side views of a folded and unfolded strip 232 having double v-cuts 340 along fold lines. The double v-cuts 340 provide an alternative fold. As with the v cut 240, the double v-cut 340 clears material out of the cut to allow for an inward fold. It should be kept in mind that folding cuts work because a slight skin remains that keeps the material together. Alternatively, a cut formed by a slit made in the material of the strip 232 could be used to fold material away from the cut. The term "double v-cut" is used for illustrative purposes only, and there are other cuts that could be made to do essentially the same thing (i.e., removes material and aids in folding).

Figure 23:
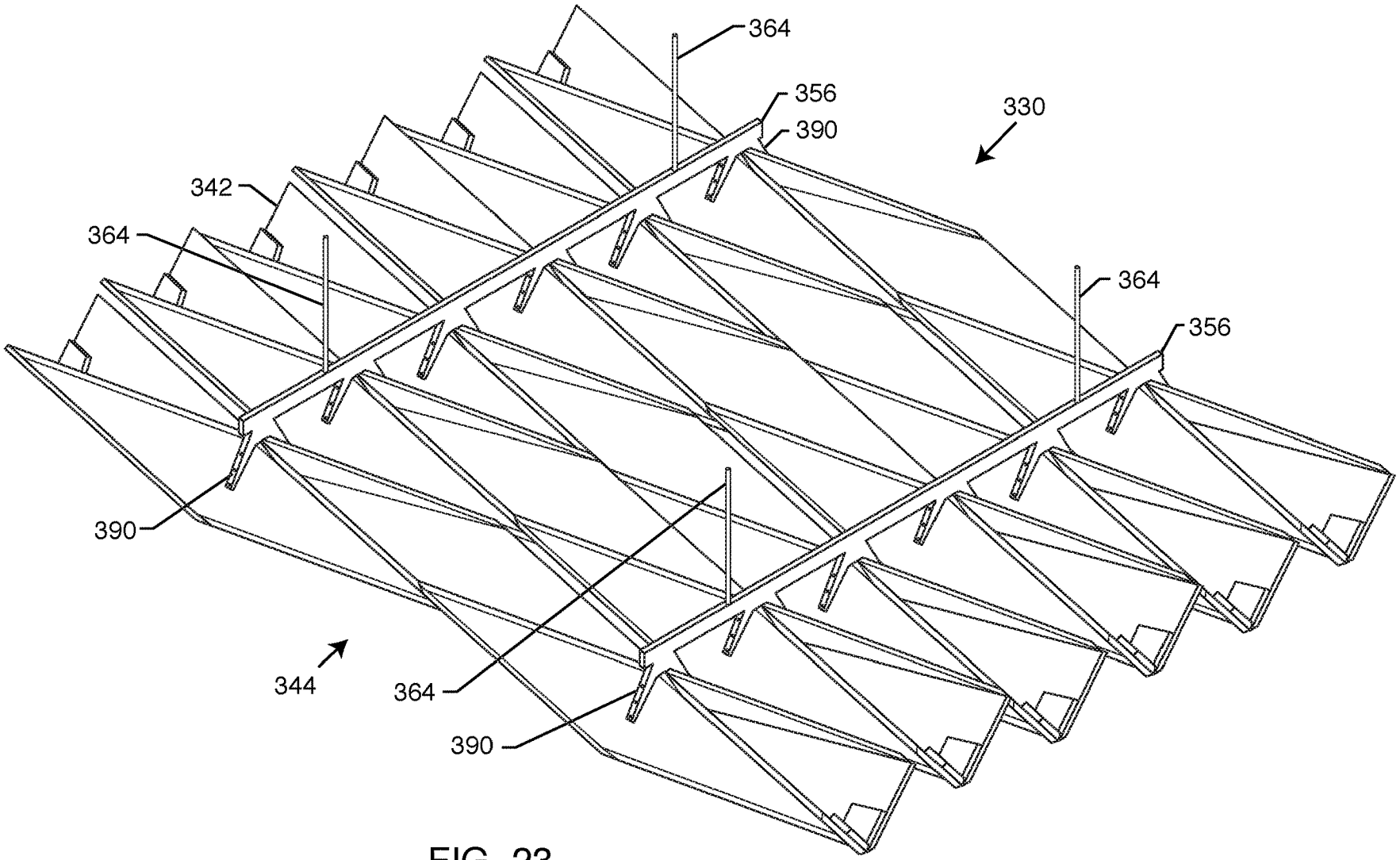
FIG. 23 is a top-side isometric view of another embodiment of a support structure assembly for supporting a faceted unit assembly.
Figure 24:
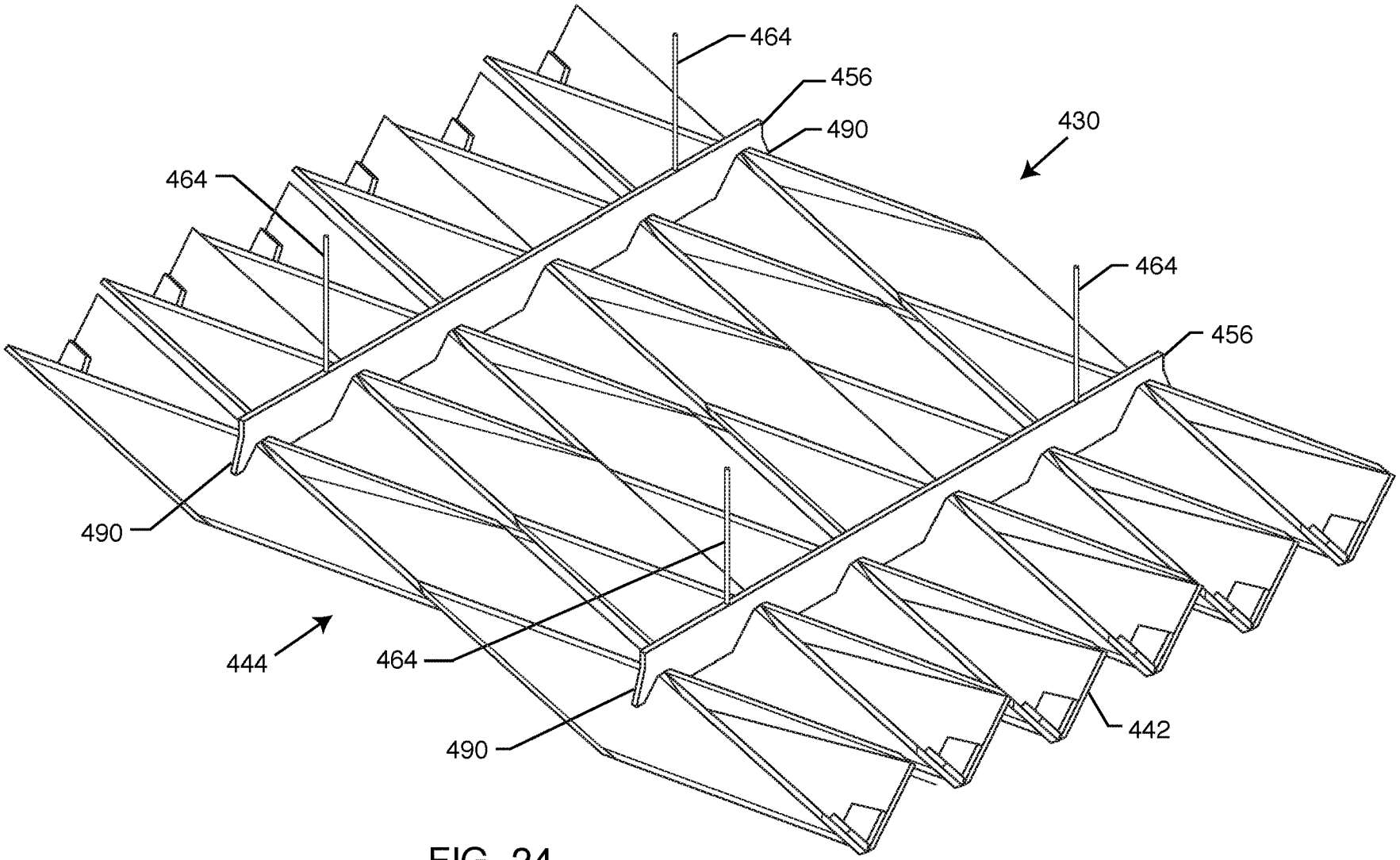
FIG. 24 is a top-side isometric view of yet another embodiment of a support structure assembly for supporting a faceted unit assembly.

Other alternative constructions for support structure assemblies are possible. For example, FIG. 23 illustrates another embodiment of a support structure assembly 344 for supporting a unit or fin assembly 342 where the support structure assembly 344 provides a pair of ribs 356 for supporting the unit or fin assembly 342. Each rib 356 includes a plurality of Y bracket portions 390 for engaging the unit or fin assembly 342. The Y bracket portions 390 may be integral or of single-piece construction with the rib 356. One end of each threaded rod 364 of a pair of threaded rods 364 directly engage each rib 356 while the other end of each threaded rod 364 is used to engage the support structure assembly 344, and by extension the entire assembly 330, to a surface (e.g., ceiling, wall, floor, etc.). The ribs 356 may be made from the same materials as those forming the strips or fins of the unit or fin assembly 342. FIG. 24 illustrates yet another embodiment of a support structure assembly 444 for supporting a unit or fin assembly 442 where the support structure assembly 444 provides a pair of ribs 456 for supporting the unit or fin assembly 442. Each rib 456 includes a plurality of Y bracket portions 490 for engaging the unit or fin assembly 442. The Y bracket portions 490 may be integral or of single-piece construction with the rib 456. One end of each threaded rod 464 of a pair of threaded rods 464 directly engage each rib 456 while the other end of each threaded rod 464 is used to engage the support structure assembly 444, and by extension the entire assembly 430, to a surface (e.g., ceiling, wall, floor, etc.). The ribs 456 may be made from the same materials as those forming the strips or fins of the unit or fin assembly 442.

While the embodiments shown in the figures exemplify fixtures in which a modular unit structure includes two joined, side-by-side, folded elongated strip, it should be readily understood that the invention also provides corresponding embodiments in which a unit structure includes a single folded elongated strip or more than two, such as three, four, five or six folded elongated strips arranged in a side-to-side manner with neighboring strips joined to teach other.

Each of the patents and publications cited herein is incorporated by reference in its entirety.

The architectural fixture may include various patterns, features, designs, logos, cartoons or the like for ornamental purposes. The architectural fixture may be monochromatic, or include various patterns (e.g., multi-color stripes, polka dots or the like) or the like for ornamental purposes.

Although the present invention has been discussed above in the context of attachment to a horizontal ceiling or vertical wall surface, the present invention may also be connected directly to or indirectly from various other surfaces (e.g., a façade, or the like). In the example of a façade, the fixture might be part of a non-acoustic application, and be made from metal that would be shaped by bending or forming (i.e., not by cutting), although a perforation could be added at the fold line/bend line to accommodate the forming of faceted surfaces.

In addition, the claimed invention is not limited in size and may be constructed in various sizes in which the same or similar principles of operation as described above would apply. Furthermore, the figures (and various components shown therein) of the specification are not to be construed as drawn to scale.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

The terminology used herein is for the purpose of describing particular example embodiments only and is not intended to be limiting. As used herein, the singular forms "a", an and the may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "front," "rear," "left," "right," "inner," "outer," "beneath", "below", "lower", "above", "upper", "horizontal", "vertical", "lateral", "longitudinal" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Moreover, features described in connection with one embodiment of the invention may be used in conjunction with other embodiments, even if not explicitly stated above. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

What is claimed is:

1. An architectural fixture comprising a top side, a bottom side and a length, composing: a plurality of architectural fixture modules configured in an array, wherein each architectural fixture module comprises a folded elongated strip including a plurality of fold lines, wherein the folded elongated strip has a longitudinal axis in its unfolded configuration, wherein the folded elongated strip is folded in alternating directions along the plurality of fold lines with each successive fold line along the elongated strip being folded in an alternating direction from the direction of a prior fold line, and wherein all the fold lines are diagonally oriented in parallel with each other in the unfolded configuration with respect to the longitudinal axis to provide a series of alternating faceted surfaces on the folded elongated strip.

2. An architectural fixture module comprising a top side, a bottom side and a length, comprising:

at least one unit structure comprising two side-by-side adjacent folded elongated strips, wherein each folded elongated strip has a longitudinal axis in its unfolded configuration and includes a plurality of fold lines, wherein each folded elongated strip is folded in alternating directions along the plurality of fold lines with each successive fold line along the elongated strip being folded in an alternating direction from the direction of a prior fold line, and wherein all the fold lines are diagonally oriented in parallel with each other in the unfolded configuration with respect to the longitudinal axis to provide a series of alternating faceted surfaces on the folded elongated strip.

3. The architectural fixture module of claim 2, wherein the two side-by-side adjacent folded elongated strips are fixed to each other.

4. The architectural fixture module of claim 2, wherein the two side-by-side adjacent folded elongated strips have an identical folded configuration.

5. The architectural fixture module of claim 4, wherein the two side-by-side adjacent folded elongated strips have a counter-directional orientation with respect to each other in the module.

6. The architectural fixture module of claim 3, further comprising a plurality of brackets sized and configured to couple the two side-by-side adjacent folded elongated strips to each other in a predetermined configuration.

7. The architectural fixture module of claim 2, further comprising at least two support attachment brackets on the top side for attaching the module to a support structure having a top and a bottom, each support attachment bracket comprising a first bottom section comprising a plate segment for attachment to one of the folded elongate strips of the unit and a second section comprising a plate segment for attachment to the other of the folded elongated strip of the unit and an upwardly extending top plate section having an expansive dimension in a plane and two lateral sides each side having a tab laterally protruding therefrom within the plane and between the two lateral sides a recess downwardly extending from the top of the support attachment bracket, wherein each of the plates segments of the first bottom section and the second bottom section is disposed in a plane transverse to the plane in which the upwardly extending top plate section is disposed in, and wherein the support attachment bracket has an inverted Y-configuration.

8. An architectural fixture, comprising:

an architectural fixture module according to claim 7; and a support structure comprising a rib/strut mutually sized and configured with the architectural fixture module to attach to the top side of the architectural fixture module, wherein the architectural fixture module is attached to the support structure.

9. An architectural fixture, comprising:

an architectural fixture module according to claim 7; and a support structure comprising a rib/strut having a slot formed in a bottom side that is sized and configured to receive the upwardly extending top plate section and a spring capture mechanism mutually sized and configured with the tabs to physically prevent the upwardly extending top plate section from being removed from the slot, wherein the architectural fixture module is attached to the support structure.

10. The architectural fixture of claim 9, wherein the spring capture mechanism comprises at each end of the slot a flat spring disposed on the back side of the slot that partially laterally extends over the slot, whereby the flat spring can pushed upward by the tabs until it passes downward to rest at the back side of the slot abutting the side of the top plate below the tabs so that the tabs come to rest on the springs.

11. The architectural fixture of claim 8, further comprising a selective release mechanism sized and configured to selectively release the upwardly extending top plate of the support attachment bracket from the spring capture mechanism.

12. The architectural fixture of claim 8, further comprising a plurality of the architectural fixture modules attached to the support structure.

13. A support attachment bracket for attaching a fixture module presenting faceted surfaces to a support structure, the support attachment bracket comprising:

a top and a bottom, with a first bottom section comprising a plate segment for attachment to a first surface of a fixture module and a second section comprising a plate segment for attachment to a second surface of a fixture module; and an upwardly extending top plate section having an expansive dimension in a plane and two lateral sides each side having a tab laterally protruding therefrom in the plane, wherein each of the plates segments of the first bottom section and the second bottom section is disposed in a plane transverse to the plane in which the upwardly extending top plate section is disposed in, and wherein the support attachment bracket has an inverted Y-configuration.

14. The support attachment bracket of claim 13, wherein between the two lateral sides a recess extends downwardly from the top of the upwardly extending top plate section.

15. The support attachment bracket of claim 13, wherein the inverted Y-configuration extends in a single plane from the upwardly extending top plate section to the bottom two arms of the inverted Y-configuration and each of the plate segments of the first bottom section and the second bottom section that is disposed in a plane transverse to the plane in which the upwardly extending top plate section is disposed in extends from the part of an arm of the two bottom arms of the inverted Y-configuration that is within the same plane as the upwardly extending top plate section.

16. The architectural fixture module of claim 2, further comprising at least a first and a second support attachment bracket on the top side for attaching the module to a support structure having a top and a bottom, each support attachment bracket comprising a first bottom section comprising a plate segment for attachment to one of the folded elongate strips of the unit and a second section comprising a plate segment for attachment to the other of the folded elongated strip of the unit and an upwardly extending top plate section having at least one hole formed there through for insertion of a fastener, wherein each of the plates segments of the first bottom section and the second bottom section is disposed in a plane transverse to the plane in which the upwardly extending top plate section is disposed in, and wherein the support attachment bracket has an inverted Y-configuration.

17. An architectural fixture, comprising:

an architectural fixture module according to claim 16;

a support structure comprising a rib/strut laterally presenting a first threaded recess mutually sized and configured to align with the at least one hole formed in the top plate section of the first support attachment bracket and a second threaded recess sized and configured to simultaneously align with the at least one hole formed in the top plate section of the second support attachment bracket;

a screw fastener screw inserted through the at least one hole formed in the top plate section of the first support attachment bracket into the first threaded recess; and a screw fastener screw inserted through the at least one hole formed in the top plate section of the second support attachment bracket into the second threaded recess, whereby the architectural fixture module is securably fixed to the rib/strut of the support structure.

18. A support attachment bracket for attaching a fixture module presenting faceted surfaces to a support structure, the support attachment bracket comprising:

a top and a bottom, with a first bottom section comprising a plate segment for attachment to a first surface of a fixture module and a second section comprising a plate segment for attachment to a second surface of a fixture module; and an upwardly extending top plate section having an expansive dimension in a plane and at least one hole formed there through sized and configured for receiving a fastener, wherein each of the plates segments of the first bottom section and the second bottom section is disposed in a plane transverse to the plane in which the upwardly extending top plate section is disposed in, and wherein the support attachment bracket has an inverted Y-configuration.

19. The support attachment bracket of claim 18, wherein the inverted Y-configuration extends in a single plane from the upwardly extending top plate section to the bottom two arms of the inverted Y-configuration and each of the plate segments of the first bottom section and the second bottom section that is disposed in a plane transverse to the plane in which the upwardly extending top plate section is disposed in extends from the part of an arm of the two bottom arms of the inverted Y-configuration that is within the same plane as the upwardly extending top plate section.

* * * * *